US006766817B2

(12) United States Patent
da Silva

(10) Patent No.: US 6,766,817 B2
(45) Date of Patent: Jul. 27, 2004

(54) FLUID CONDUCTION UTILIZING A REVERSIBLE UNSATURATED SIPHON WITH TUBARC POROSITY ACTION

(75) Inventor: Elson Dias da Silva, Campinas (BR)

(73) Assignee: Tubarc Technologies, LLC, Albuquerque, NM (US)

( * ) Notice: Subject to any disclaimer, the term of this patent is extended or adjusted under 35 U.S.C. 154(b) by 327 days.

(21) Appl. No.: 10/082,370

(22) Filed: Feb. 25, 2002

(65) Prior Publication Data

US 2003/0160844 A1 Aug. 28, 2003

Related U.S. Application Data

(60) Provisional application No. 60/307,800, filed on Jul. 25, 2001.

(51) Int. Cl.[7] ..... F04F 10/00

(52) U.S. Cl. ..... 137/1; 137/132; 137/142

(58) Field of Search ..... 137/1, 132, 142

(56) References Cited

U.S. PATENT DOCUMENTS

| | | | | |
|---|---|---|---|---|
| 4,124,035 | A | 11/1978 | Rice | 137/128 |
| 4,324,070 | A | 4/1982 | Swisher | 47/66 |
| 4,571,985 | A | 2/1986 | Daly | 73/38 |
| 4,634,305 | A | 1/1987 | Herrnring | 401/151 |
| 4,708,506 | A | 11/1987 | Herrnring | 401/151 |
| 4,745,707 | A | 5/1988 | Newby | 47/79 |
| 4,759,857 | A | 7/1988 | Acuna | 210/741 |
| 4,967,207 | A | 10/1990 | Ruder | 346/140 |
| 4,993,186 | A | 2/1991 | Immonen | 47/79 |
| 5,006,264 | A | 4/1991 | Acuna | 210/741 |
| 5,097,626 | A | 3/1992 | Mordoch | 47/79 |
| 5,099,609 | A | 3/1992 | Yamauchi | 47/81 |
| 5,129,183 | A | 7/1992 | Haw | 47/81 |
| 5,161,407 | A | 11/1992 | Ankeny et al. | 73/38 |
| 5,189,834 | A | 3/1993 | Green | 47/62 |
| 5,207,524 | A | 5/1993 | Arnold III | 401/210 |
| 5,280,300 | A | 1/1994 | Fong et al. | 346/1.1 |
| 5,342,136 | A | 8/1994 | Fukami | 401/135 |
| 5,518,331 | A | 5/1996 | Moosmann et al. | 401/230 |
| 5,520,248 | A | 5/1996 | Sisson et al. | 166/250.02 |

(List continued on next page.)

FOREIGN PATENT DOCUMENTS

| | | | |
|---|---|---|---|
| EP | 0 692 186 A1 | 7/1995 | A01G/27/04 |
| EP | 1 095 779 A2 | 10/2000 | B41J/2/175 |
| WO | WO 99/51079 | 4/1998 | |
| WO | WO 00/69251 | 5/1999 | A01G/27/04 |

OTHER PUBLICATIONS

N.C. Rudd, A.W. Naugle & T. Harter; "A GIS–linked conjuctive use groundwater–surface water flow model for the Tule River Basin, southeastern San Joaquin Valley, California"; Proceedings, IAHS/IAHR ModelCare 99, Zurich, Switzerland, Sep. 20–23, 199.

United States Department of Agriculture, "Chapter 7, Geologic and Ground Water Considerations"; 210–vi–AWMFH, rev. 3, Jun. 1999.

(List continued on next page.)

*Primary Examiner*—Gerald A. Michalsky
(74) *Attorney, Agent, or Firm*—Kermit D. Lopez; Luis M. Ortiz; Ortiz & Lopez, PLLC

(57) ABSTRACT

A method and system for harnessing an unsaturated flow of fluid utilizing a reversible unsaturated siphon conductor of fluid having a tubarc porous microstructure. Fluid is conducted from a zone of higher (+) fluid matric potential to a zone of lower (–) fluid matric potential utilizing a tubarc porous microstructure. The fluid can be reversibly transported from different zones bearing a differential fluid matric potential according to the status of the fluid matric potential in each zone utilizing the tubarc porous microstructure. The tubarc porous microstructure comprises an enhanced geometric porosity. In this manner, the fluid can be harnessed for irrigation, drainage, filtration, fluid recharging and other fluid delivery uses, such as refilling writing and printing instruments.

35 Claims, 23 Drawing Sheets

U.S. PATENT DOCUMENTS

| | | | | |
|---|---|---|---|---|
| 5,622,004 | A | 4/1997 | Gidge | 47/71 |
| 5,626,431 | A | 5/1997 | Hetzer et al. | 401/119 |
| 5,631,681 | A | 5/1997 | Klaus et al. | 347/85 |
| 5,655,847 | A | 8/1997 | Kobayashi et al. | 401/219 |
| 5,703,633 | A | 12/1997 | Gehrer et al. | 347/86 |
| 5,751,321 | A | 5/1998 | Erickson | 347/85 |
| 5,797,217 | A | 8/1998 | Magee | 47/79 |
| 5,802,818 | A | 9/1998 | Doll et al. | 53/468 |
| 5,806,241 | A | 9/1998 | Byland et al. | 47/81 |
| 5,839,659 | A | 11/1998 | Murray | 239/1 |
| 5,842,309 | A | 12/1998 | Skier | 47/48.5 |
| 5,861,750 | A | 1/1999 | Anderson et al. | 324/347 |
| 5,917,523 | A | 6/1999 | Baldwin et al. | 347/85 |
| 5,921,025 | A | 7/1999 | Smith | 47/79 |
| 5,929,878 | A | 7/1999 | Pelletier | 347/28 |
| 5,934,017 | A | 8/1999 | Ho | 47/79 |
| 5,956,899 | A | 9/1999 | DiOrio | 47/80 |
| 5,971,532 | A | 10/1999 | Toda | 347/86 |
| 5,984,559 | A | 11/1999 | Shiobara et al. | 401/214 |
| 6,003,982 | A | 12/1999 | Curley | 347/85 |
| 6,048,054 | A | 4/2000 | Ando et al. | 347/85 |
| 6,056,463 | A | 5/2000 | Nishio et al. | 401/47 |
| 6,068,422 | A | 5/2000 | Smith | 401/195 |
| 6,079,156 | A | 6/2000 | Colovic | 47/81 |
| 6,116,297 | A | 9/2000 | Feygin | 141/31 |
| 6,161,329 | A | 12/2000 | Spelt | 47/67 |
| 6,164,766 | A | 12/2000 | Erickson | 347/85 |
| 6,178,691 | B1 | 1/2001 | Caron et al. | 47/79 |
| 6,178,984 | B1 | 1/2001 | Amsellem | 137/142 |
| 6,205,706 | B1 | 3/2001 | Buss | 47/48.5 |
| 6,209,258 | B1 | 4/2001 | Schneider | 47/46 |
| 6,219,969 | B1 | 4/2001 | Dion | 47/79 |
| 6,226,921 | B1 | 5/2001 | Kang | 47/81 |
| 6,237,283 | B1 | 5/2001 | Nalbandian et al. | 47/48.5 |
| 6,238,042 | B1 | 5/2001 | Kobayashi et al. | 347/86 |

OTHER PUBLICATIONS

Diane S. Roote; "In Situ Flushing"; Technology Overview Report, Ground–Water Remediation Technologies Analysis Center, Jun. 1997.

U.S. Department of Energy, Office of Environmental Management; "Technology Description"; May 1, 1997; http://www.em.doe.gov/define/techn/rp–insit.html.

Scott B. Jones & Dani Or; "Design of Porous Media for Optimal Gas and Liquid Fluxes to Plant Roots"; Soil Sci. Soc. Am. J. 62:563–573 (1998).

"Glossary"; 210–vi–AWMFH, rev. 1, Jul. 1996.

Clark et al.; "Maintaining Drip Irrigation Systems"; Kansas State University Agricultural Experiment Station and Cooperative Extension Service; Apr., 1996.

Thomas Scherer & James Weigel; "Planning to Irrigate . . . A Checklist", AE–92, Dec. 1993, http://www.ext.nodak.edu/extpubs/ageng/irrigate/ae92w.htm.

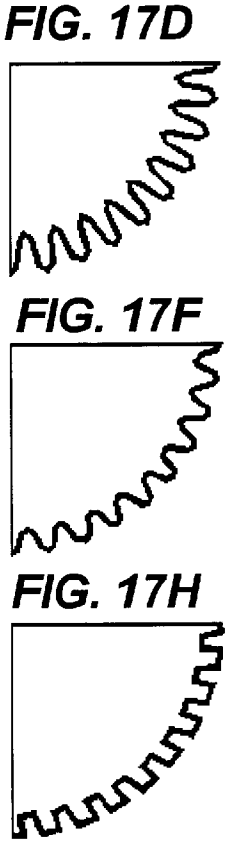
FIG. 17D
FIG. 17F
FIG. 17H
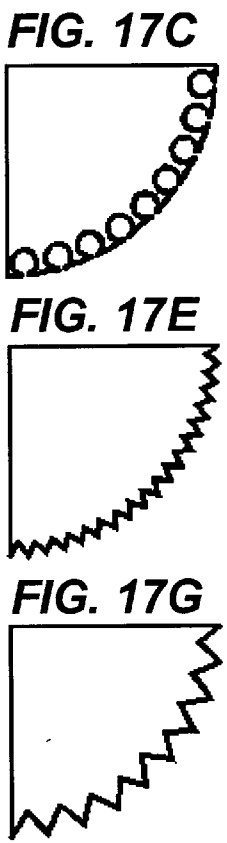
FIG. 17C
FIG. 17E
FIG. 17G
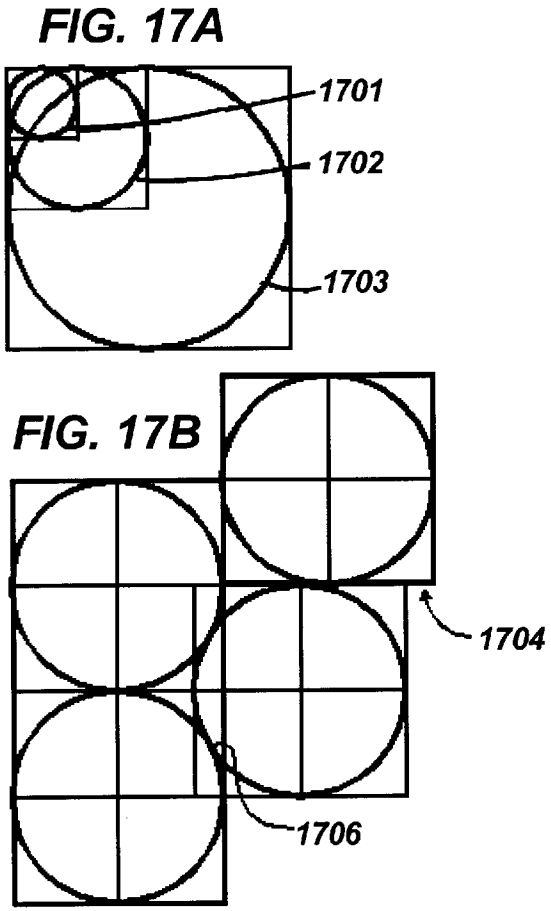
FIG. 17A
1701
1702
1703
FIG. 17B
1704
1706

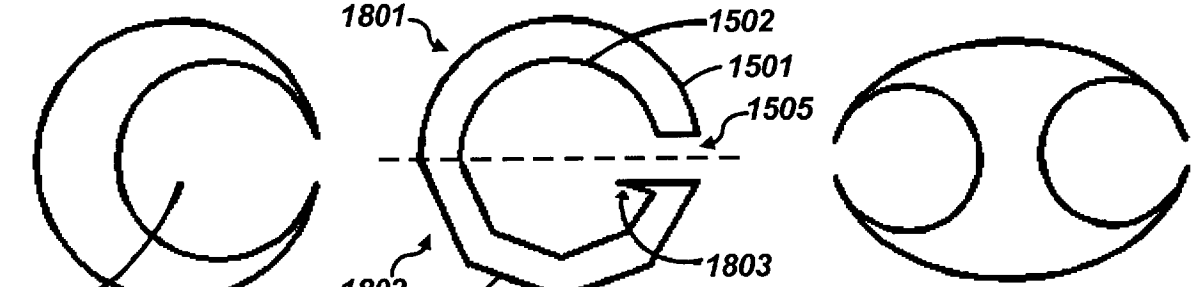
FIG. 18A
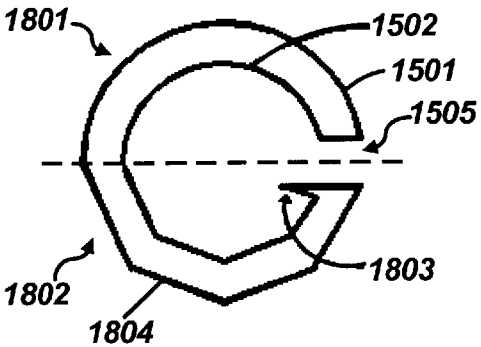
FIG. 18B
FIG. 18C
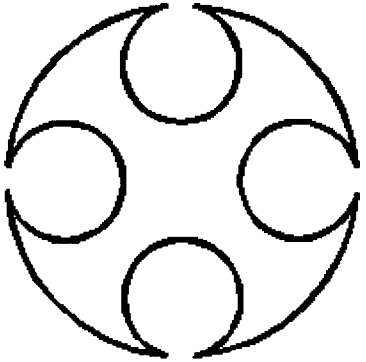
FIG. 18D
FIG. 18E
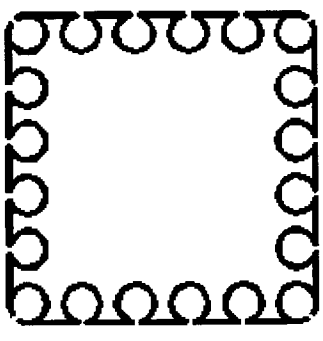
FIG. 18F

FLUID CONDUCTION UTILIZING A REVERSIBLE UNSATURATED SIPHON WITH TUBARC POROSITY ACTION

CROSS REFERENCE TO PROVISIONAL PATENT APPLICATION

This patent application is related to U.S. Provisional Patent Application, "Fluid Conduction Utilizing a Reversible Unsaturated Siphon With Tubarc Porosity Action," Serial No. 60/307,800, filed on Jul. 25, 2001. This patent application claims the Jul. 25, 2001 filing date of the above referenced provisional patent application.

TECHNICAL FIELD

The present invention relates generally to fluid delivery methods and systems. The present invention also relates to methods and systems for hydrodynamically harnessing the unsaturated flow of fluid. The present invention additionally relates to the geometry of physical macro and microstructures of porosity for fluid conduction and retention as unsaturated hydric condition.

BACKGROUND OF THE INVENTION

Fluid delivery methods and systems are highly desirable for irrigation, filtration, fluid supply, fluid recharging and other fluid delivery purposes. The ability to deliver proper amounts of fluid to plants, chambers, compartments or other devices in a constant and controlled manner is particularly important for maintaining constant plant growth or supplying liquid to devices that require fluid to function properly. Fluids in general need to move from one place to another in nature as well as in innumerous technological processes. Fluids may be required in places where the availability of fluid is not expected (i.e., supply). Fluids may also be undesired in places where the fluid is already in place (i.e., drainage). Maintaining the fluid cycling dynamically permits the transference of substances in solutions moving from place to place, such as the internal functioning of multicellular organisms. The process of moving fluid as unsaturated flow also offers important features associated with characteristics, including the complex hydrodynamic interaction of fluid in the liquid phase in association with the spatially delineated porosity of the solid phase.

Fluid movement is also required to move substances in or out of solutions or which may be suspended in a flow. Bulk movement of fluids has been performed efficiently for centuries inside tubular cylindrical objects, such as pipes. Often, however, fluids are required to be delivered in very small amounts at steady ratios with a high degree of control governed by an associated fluid or liquid matric potential. Self-sustaining capabilities controlled by demand are also desired in fluid delivery systems, along with the ability to maintain ratios of displacement with the porosity of solid and air phases for efficient use. Field irrigation has not yet attained such advancement because the soil is not connected internally to the hose by any special porous interface. This particular need can be observed within plants and animals in biological systems, in the containerized plant industry, printing technology, writing tools technology, agricultural applications (i.e., irrigation/drainage), fluid-filtering, biotechnology-like ion-exchange chromatography, the chemical industries, and so forth.

A fluid that possesses a positive pressure can be generally defined in the field of hydrology as saturated fluid. Likewise, a fluid that has a negative pressure (i.e., or suction) can be generally defined as an unsaturated fluid. Fluid matric potential can be negative or positive. For example, water standing freely at an open lake, can be said to stand under a gravity pull. The top surface of the liquid of such water accounts for zero pressure known as the water table or hydraulic head. Below the water table, the water matric potential (pressure) is generally positive because the weight of the water increases according to parameters of force per unit of area. When water rises through a capillary tube or any other porosity, the water matric potential (e.g., conventionally negative pressure or suction) is negative because the solid phase attracts the water upward relieving part of its gravitational pull to the bearing weight. The suction power comes from the amount of attraction in the solid phase per unit of volume in the porosity.

A tube is a perfect geometrical figure to move bulk fluids from one place to another. For unsaturated flow, however, a tube is restricted because it will not permit lateral flow of fluid in the tube walls leading to anisotropic unsaturated flow with a unique longitudinal direction. Tube geometry is very important when considering applications of fluid delivery and control involving saturated conditions, such as, for example in pipes. The wall impermeability associated with tube geometry thus becomes an important factor in preventing fluid loss and withstanding a high range of pressure variation. In such a situation, fluids can move safely in or out only through associated dead ends of an empty tube or cylinder.

Random irregular porous systems utilized for unsaturated flow employ general principles of capillary action, which require that the tube geometry fit properly to the porosity, which is generally analogous to dimensions associated between capillary tubes and the voids in the random porosity. Random porosity has an irregular shape and a highly variable continuity in the geometrical format of the void space, which does not fit to the cylindrical spatial geometry of capillary tubes. This misunderstanding still holds true due to the fact that both capillary tubes and porosity voids are affected by the size of pores to retain and move fluids as unsaturated conditions. Consequently, an enhanced porosity for unsaturated flow that deals more clearly with the spatial geometry is required. This enhanced porosity becomes highly relevant when moving fluids between different locations by unsaturated conditions if reliability is required in the flow and control of fluid dynamic properties.

When fluids move as unsaturated flow, they are generally affected by the porosity geometry, which reduces the internal cohesion of the fluid, thereby making the fluid move in response to a gradient of solid attraction affecting the fluid matric potential. Continuity pattern is an important factor to develop reliability in unsaturated flow. Continuous parallel solid tube-like structures offer this feature of regular continuity, thereby preventing dead ends or stagnant regions common to the random microporosity. The system becomes even more complex because the fluid-holding capacity of the porosity has a connective effect of inner fluid adhesion-cohesion, pulling the molecules down or up. Using common cords braided with solid cylinders of synthetic fibers, a maximum capillary rise of near two feet has been registered.

Specialized scientific literature about unsaturated zones also recognizes this shortcoming. For example: "Several differences and complications must be considered. One complication is that concepts of unsaturated flow are not as fully developed as those for saturated flow, nor are they as easily applied." (See Dominico & Schwartz, 1990. Physical and Chemical Hydrogeology. Pg. 88. Wiley). Concepts of unsaturated flow have not been fully developed to date, because the "capillary action" utilized to measure the adhesion-cohesion force of porosity is restrained by capillary tube geometry conceptions. The term "capillary action" has been wrongly utilized in the art as a synonym for unsaturated flow, which results in an insinuation that the tube geometry conception captures this phenomenon when in truth it does not.

The present inventor disclosed a one-way upward capillary conductor in a Brazilian patent application, *Artificial System to Grow Plants*, BR P1980367, Apr. 4, 1998. The configuration disclosed in BR P1980367 is limited because it only permits liquid to flow upward from saturated to unsaturated zones utilizing a capillary device, which implies a type of tubular structure. The capillary conductor claimed in the Brazilian patent application has been found to contain faulty functioning by suggesting the use of an external constriction layer and an internal longitudinal flow layer. Two layers in the conductor have led to malfunctioning by bringing together multiple differential unsaturated porous media, which thereby highly impairs flow connectivity.

Unsaturated flow is extremely dependent on porosity continuity. All devices using more than one porous physical structure media for movement of unsaturated fluid flow are highly prone to malfunctioning because of the potential for microscopic cracks or interruptions in the unsaturated flow of fluid in the media boundaries. Experimental observations have demonstrated that even if the flow is not interrupted totally, the transmittance reduction becomes evident during a long period of observation.

The appropriate dimensions and functioning of porosity can be observed in biological unsaturated systems because of their evolutionary development. Internal structures of up to 100 $\mu$m in cross-sectional diameter, such as are present, for example, in the phloem and xylem vessels of plants are reliable references. But, interstitial flow between cells function under a 10 $\mu$m diameter scale. It is important to note that nature developed appropriate patterns of biological unsaturated flow porosity according to a required flow velocity, which varies according to a particular organism. These principals of unsaturated flow are evidenced in the evolution and development of plants and animals dating back 400 millions years, and particularly in the early development of multicellular organisms. These natural fluid flow principles are important to the movement of fluids internally and over long upward distances that rely on the adhesion-cohesion of water, such as can be found in giant trees, or in bulk flow as in vessels. Live beings, for example, require fluid movement to and from internal organs and tissues for safe and proper body functioning.

Plants mastered unsaturated flow initially in their need to grow and expand their bodies far beyond the top surface in search of sunlight and to keep their roots in the ground for nutrients and water absorption. Plants learned to build their biological porosity block by block through molecular controlled growth. Plants can thus transport fluid due to their own adhesion-cohesion and to the special solid porosity of the associated tissues, providing void for flow movement and solid structure for physical support. Plants not only developed the specially organized porosity, but also the necessary fluid control based on hydrophilic and hydrophobic properties of organic compounds in order to attract or repel water, internally and externally according to metabolic specific requirements. Plants learned to build their biological porosity controlling the attraction in the solid phase by the chemistry properties of organic compounds as well as their arrangement in an enhanced spatial geometry with appropriate formats for each required unsaturated flow movement pattern.

The one-way capillary conductor disclosed by Silva in Brazilian patent application BR P1980367 fails to perform unsaturated siphoning due to tubing theory and a one-way upward flow arrangement. A tube is not an appropriate geometrical containing figure for unsaturated flow because it allows fluids to move in and out only by the ends of the hollow cylindrical structure. A one-way directional flow in a pipe where the fluid has to pass through the ends of the pipe is highly prone to malfunctioning due to clogging, because any suspended particles in the flow may block the entrance when such particles is larger than the entrance. Unsaturated flow requires multidirectional flow possibilities, as well as a special spatial geometry of the porosity to provide continuity. Unsaturated flow in a conductor cannot possess walls all around the tube for containment. According to Webster's Dictionary, the term capillary was first coined in the $15^{th}$ century, describing a configuration having a very small bore (i.e., capillary tube). Capillary attraction (1830) was defined as the force of adhesion and cohesion between solid and liquid in capillarity. Consequently, a geometric tube having a small structure can only function one-way upward or downward without any possibility of lateral flow. Capillary action operating in a downward direction can lose properties of unsaturated flow because of an saturated siphoning effect, which results from the sealing walls.

The complexity of unsaturated flow is high, as the specialized literature has acknowledged. For example, the inner characteristics between saturated flow and unsaturated flows are enormous and critical to develop reliability for unsaturated flow applications. Interruption of continuity on pipe walls of saturated flow leads to leaking and reduced flow velocity. In the case of unsaturated flow interruption in the continuity can be fatal halting completely the flux. This can occur because the unsaturated flow is dependent on the continuity in the solid phase, which provides adhesion-cohesion connectivity to the flowing molecules. Leaking offers an easy detection feature to impaired saturated flow, but cracking is neither perceptible nor easy to receive remedial measures in time to rescue the unsaturated flow functioning imposed by the sealing walls.

The efficiency of unsaturated flow is highly dependent on porosity continuity and the intensity ratio of attraction by unit of volume. A simple water droplet hanging from a horizontal flat surface having approximately 4 mm of height, for example, can have vertical chains of water molecules of approximately 12 million molecules linked to one other by hydrogen bonding and firmly attached to the solid material that holds it. Water in a hanging droplet has a ratio of 1:0.75 holding surface to volume. If this water were stretched vertically into a tube of 10 $\mu$m of diameter, the water column can reach 213 m high. The relation of surface to volume can increase to more than five hundred times, explaining the high level of attraction in the porosity to move fluids by the reduction of their bearing weight and consequent increase of dragging power of porosity. If the diameter were only 5 $\mu$m, the water column can reach 853 m for this simple water droplet.

The amount of attraction in the porosity by volume is dependent on the shape format of the solid surface as well as its stable spatial continuity. The rounding surfaces are generally the best ones to concentrate solid attraction around a small volume of fluid. Cubes offer the highest level of surface by volume, but such cubes neither provide a safe void for porosity nor rounding surfaces. A sphere offers a high unit of surface by volume. Sphere volume can occupy near 50% of the equivalent cube. Granular soil structure usually has around 50% of voids associated with the texture of soil aggregates. A void in the granular porous structure offers low reliability for continuity because the granules cannot be attached safely to each other and the geometry of the void randomly misses an ensured connectivity. Cells are granule-like structures in the tissues of life-beings that learned to attach to each other in a precise manner pin order to solve such a dilemma. Larger spherical particles can offer much more surface area than cylindrical particles, because the surface area of spheres increases according to the cubic power of the radius, while the cylinders increase to multiples of the radius without considering the circle area. On the other hand, smaller and smaller geometrical formats lead to more reduction of the surface of spherical formats than cylindrical formats. Cylinders also maintain a regular longitudinal shape pattern because it can be stretched to any length aimed in industrial production. A bundle of cylinders changing size have a preserved void ratio and an inverse relation of solid attraction to volume bearing weight in the porosity.

The present inventor has thus discovered that the dynamics between saturated and unsaturated conditions as expressed in the fluid matric potential can be utilized to harness the unsaturated flow of fluid using the macrostructure of reversible unsaturated siphons for a variety of purposes, such as irrigation and drainage, fluid recharging and filtration, to name a few. The present inventor has thus designed unique methods and systems to recover or prevent interruption in liquid unsaturated flow in both multidirectional and reversible direction by taking advantage of the intrinsic relationship between unsaturated and saturated hydrological zones handling a vertical fluid matric gradient when working under gravity conditions. The present inventor has thus designed an enhanced microporosity called tubarc, which is a tube like geometric figure having continuous lateral flow in all longitudinal extension. The tubarc porosity offers a high level of safe interconnected longitudinally, while providing high anisotropy for fluid movement and reliability for general hydrodynamic applications.

BRIEF SUMMARY OF THE INVENTION

The following summary of the invention is provided to facilitate an understanding of some of the innovative features unique to the present invention, and is not intended to be a full description. A full appreciation of the various aspects of the invention can be gained by taking the entire specification, claims, drawings, and abstract as a whole.

It is therefore one aspect of the present to provide fluid delivery methods and systems.

It is another aspect of the present invention to provide a specific physical geometric porosity for hydrodynamically harnessing the unsaturated flow of fluid.

It is another aspect of the present invention to provide methods and systems for hydrodynamically harnessing the unsaturated flow of fluid.

It is yet another aspect of the present invention to provide methods and systems for harnessing the flow of unsaturated fluid utilizing tubarc porous microstructures.

It is another aspect of the present invention to provide a tubarc porous microstructure that permits unsaturated fluid to be conducted from a saturated zone to an unsaturated zone and reversibly from an unsaturated zone to a saturated zone.

It is still another aspect of the present invention to provide improved irrigation, filtration, fluid delivery, fluid recharging and fluid replacement methods and systems.

It is one other aspect of the present invention to provide a reliable solution to reversibly transport fluids between two compartments according to a fluid matric potential gradient, utilizing an unsaturated siphon bearing a high level of self-sustaining functioning.

It is another aspect of the present invention to provide efficient methods and system of performing drainage by molecular attraction utilizing the characteristics of fluid connectivity offered by a reversible unsaturated siphon and tubarc action enhanced microporosity.

It is an additional aspect of the present invention to provide a particular hydrodynamic functioning of a reversible unsaturated siphon, which can be utilized to deliver fluids with an adjustable negative or positive fluid matric potential, thereby attending specific local delivery requirements.

It is yet another aspect of the present invention to provide an improved microporosity of tubarc arrangement having multidirectional reversible unsaturated flow.

It is still another aspect of the present invention to provide a safe reversible unsaturated siphon to carry and deliver solutes or suspended substances according to a specific need.

It is a further aspect of the present invention to provide a reliable filtering solution for moving fluids between saturated and unsaturated conditions passing through zones of unsaturated siphons.

The above and other aspects can be achieved as will now be summarized. Methods and systems for harnessing unsaturated flow of fluid utilizing a conductor of fluid having a tubarc porous microstructure are disclosed. The conductor of fluid may be configured as a reversible unsaturated siphon. Fluid can be conducted from a region of higher fluid matric potential to a region of lower fluid matric potential utilizing a reversible unsaturated siphon with tubarc porous microstructure (e.g., positive zone to negative zone). The fluid may then be delivered from the higher fluid matric potential zone to the lower fluid matric potential zone through the reversible unsaturated siphon with tubarc porous microstructure, thereby permitting the fluid to be harnessed through the hydrodynamic fluid matric potential gradient. The fluid is reversibly transportable utilizing the tubarc porous microstructure whenever the fluid matric potential gradient changes direction.

The fluid is hydrodynamically transportable through the tubarc porous microstructure according to a gradient of unsaturated hydraulic conductivity. In this manner, the fluid can be harnessed for irrigation, filtration, fluid recharging and other fluid delivery uses, such as refilling writing instruments. The methods and systems for saturated fluid delivery described herein thus rely on a particular design of porosity to harness unsaturated flow. This design follows a main pattern of saturation, unsaturation, followed by saturation. If the fluid is required as an unsaturated condition, then the design may be shortened to saturation followed by unsaturation. Liquids or fluids can move from one compartment to another according to a gradient of unsaturated hydraulic conductivity, which in turn offers appropriate conditions for liquid or fluid movement that takes into account connectivity and adhesion-cohesion of the solid phase porosity.

The reversible unsaturated siphon disclosed herein can, for example, be formed as an unsaturated conductor having a spatial macrostructure arrangement of an upside down or downward U-shaped structure connecting one or more compartments within each leg or portions of the siphon, when functioning under gravity conditions. The upper part of the siphon is inserted inside the unsaturated zone and the lower part in the saturated zone, in different compartments. The unsaturated siphon moves fluids from a compartment or container having a higher fluid matric potential to another compartment or container having a lower fluid matric potential, with reversibility whenever the gradients are reversed accordingly. The reversible unsaturated siphon can be configured as a simple and economical construction offering highly reliable functioning and numerous advantages. The two compartments in the saturated zones can be physically independent or contained, one inside the other. The compartments can be multiplied inside the saturated and/or unsaturated zones depending on the application requirements. The two legs can be located inside two different saturated compartments, while the upper part of the siphon also may be positioned inside other compartments where the requirement of unsaturated condition might be prevalent. The penetration upward of the upper siphon part in the unsaturated zone provides results of the flow movement dependent on unsaturated flow characteristics associated to the decreasing (−) fluid matric potential.

The reversible unsaturated siphon of the present invention thus can generally be configured as a macrostructure structure connecting two or more compartments between saturated and unsaturated zones. Such a reversible unsaturated siphon has a number of characteristics, including automatic flow, while offering fluid under demand as a self-sustaining effect. Another characteristic of the reversible unsaturated siphon of the present invention includes the ability to remove fluid as drainage by molecular suction. Additionally, the reversible unsaturated siphon of the present invention can control levels of displacement of solid, liquid, and air and offers a high level of control in the movement of fluids. The reversible unsaturated siphon of the present invention also can utilize chemically inert and porous media, and offers a high level anisotropy for saturated and unsaturated fluid flow. The reversible unsaturated siphon of the present invention additionally offers high reliability for bearing a flexible interface of contact, and a high index of hydraulic conductivity and transmissivity. Additional characteristics of the reversible unsaturated siphon of the present invention can include a filtering capability associated with the control of the size of porosity and the intensity of negative pressure applied in the unsaturated zone, a low manufacturing cost, high evaporative surfaces for humidifying effects, and a precise delivery of fluid matric potential for printing systems.

BRIEF DESCRIPTION OF THE DRAWINGS

The accompanying figures, in which like reference numerals refer to identical or functionally-similar elements throughout the separate views and which are incorporated in and form part of the specification, further illustrate the present invention and, together with the detailed description of the invention, serve to explain the principles of the present invention.

FIG. 17A depicts a cross-sectional view of a spatial geometric modeling of cylinders in increasing double radius sizes, in accordance with a preferred embodiment of the present invention;

FIG. 17B illustrates a cross-sectional view of a spatial geometry arrangement of cylinders joined in the sides, in accordance with a preferred embodiment of the present invention;

FIG. 17C depicts a cross-sectional view of a spatial geometry of a cylinder surface sector having multiple tubarcs to increase the fluid transmission and retention, in accordance with a preferred embodiment of the present invention;

FIG. 17D illustrates a cross-sectional view of a spatial geometry of a cylinder sector having a jagged surface in the format of villosities to increase the surface area, in accordance with a preferred embodiment of the present invention;

FIG. 17E depicts a cross-sectional view of a spatial geometry of a cylinder sector having a jagged surface in the format of small V-shaped indentation to increase the surface area, in accordance with a preferred embodiment of the present invention;

FIG. 17F illustrates a cross-sectional view of a spatial geometry of a cylinder sector having a jagged surface in the format of rounded indentation to increase the surface area, in accordance with a preferred embodiment of the present invention;

FIG. 17G depicts a cross-sectional view of a spatial geometry of a cylinder sector having a jagged surface in the format of V-shape indentation to increase the surface area, in accordance with a preferred embodiment of the present invention;

FIG. 17H illustrates a cross-sectional view of a spatial geometry of a cylinder sector having a jagged surface in the format of squared indentation to increase the surface area, in accordance with a preferred embodiment of the present invention;

FIG. 18A depicts a cross-sectional view of a spatial geometry of a cylindrical fiber with a unique standard tubarc format, in accordance with a preferred embodiment of the present invention;

FIG. 18B illustrates a cross-sectional view of a spatial geometry of a cylindrical fiber with a unique optionally centralized tubarc format having rounded or non-rounded surfaces, in accordance with a preferred embodiment of the present invention;

FIG. 18C depicts a cross-sectional view of a spatial geometry of an ellipsoid fiber with two standard tubarcs, in accordance with a preferred embodiment of the present invention;

FIG. 18D illustrates a cross-sectional view of a spatial geometry of a cylindrical fiber with three standard tubarcs, in accordance with a preferred embodiment of the present invention;

FIG. 18E depicts a cross-sectional view of a spatial geometry of a cylindrical fiber with four standard tubarcs, in accordance with a preferred embodiment of the present invention;

FIG. 18F illustrates a cross-sectional view of a spatial geometry of a squared fiber with multiple standard tubarcs, in accordance with a preferred embodiment of the present invention;

DETAILED DESCRIPTION OF THE INVENTION

The particular values and configurations discussed in these non-limiting examples can be varied and are cited merely to illustrate embodiments of the present invention and are not intended to limit the scope of the invention.

The figures illustrated herein depict the background construction and functioning of a reversible unsaturated siphon having a tubarc porous physical microstructure for multidirectional and optionally reversible unsaturated flow, in accordance with one or more preferred embodiments of the present invention.

Figure 1:
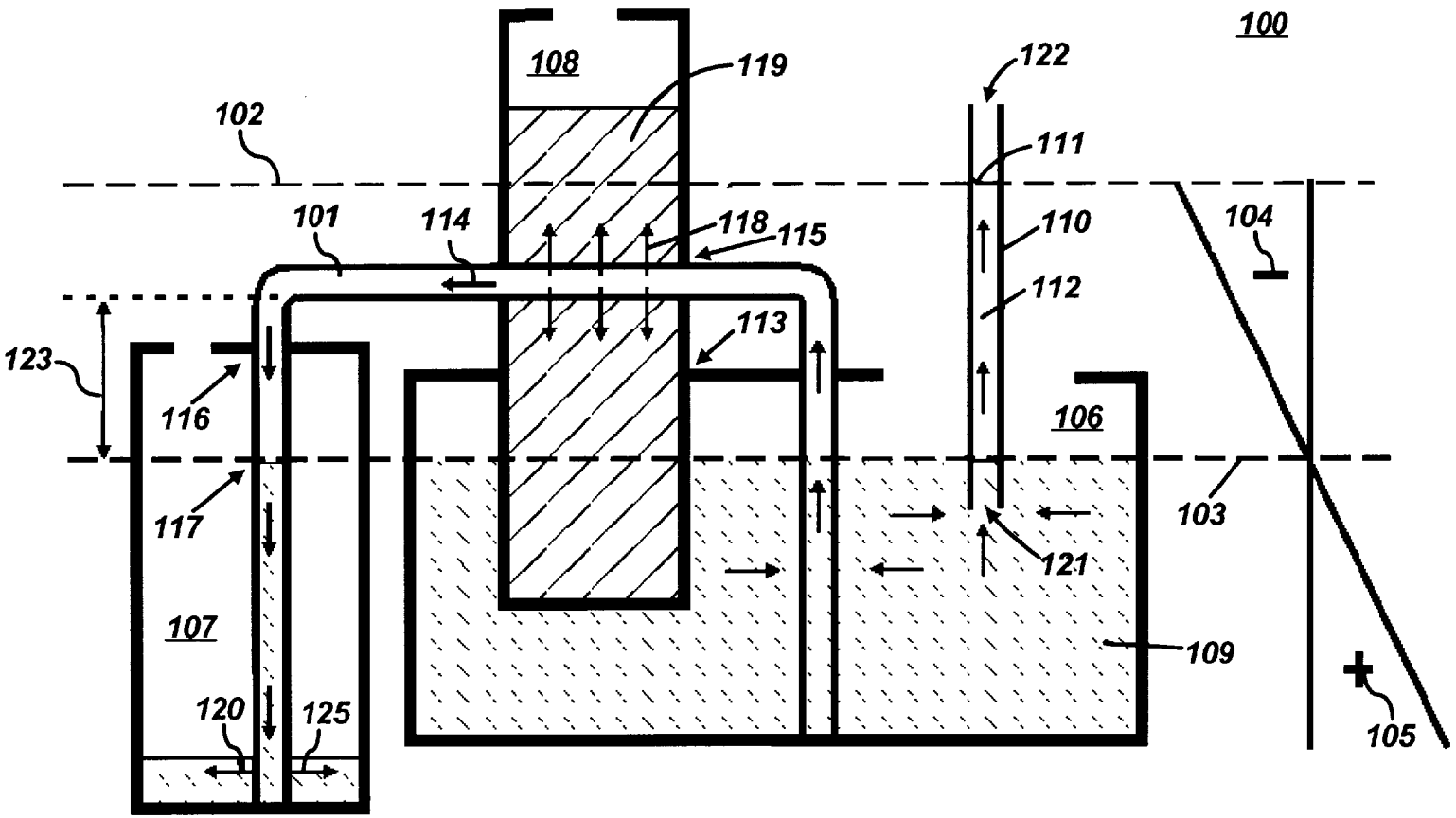
FIG. 1 illustrates a cross-sectional view of a hydrodynamic model of saturation and unsaturation zones illustrating reversible unsaturated siphon functioning compared to capillary rise theory in potentially multiple compartments.

FIG. 1 illustrates a sectional view of a hydrodynamic model 100 (i.e., a system 100) illustrating saturation zones and unsaturation zones in accordance with a preferred embodiment of the present invention. Hydrodynamic model 100 illustrated in FIG. 1 is presented in order to depict general capillary rise theory and the functioning of a U-shaped upside down reversible unsaturated siphon 101. Note that in FIGS. 1 to 23 herein, similar or analogous parts are generally indicated by identical reference numerals.

FIG. 1 demonstrates the use of capillary tubes and reversible unsaturated siphon in water transfer. The present invention, however, does not rely on capillary tubes. The discussion of capillary tubes herein is presented for illustrative purposes only and to explain differences between the use of capillary tubes and the methods and systems of the present invention. The hydrodynamic model 100 depicted in FIG. 1 generally illustrates accepted theories of unsaturated flow, which are based on conceptions of capillary action. In FIG. 1, an illustrative capillary tube 110 is depicted. Capillary tube 110 contains two open ends 121 and 122, which promote liquid movement upward as unsaturated flow. It is accepted in the scientific literature that fluid 109 can rise in illustrative capillary tube 110, which contains the two open ends 121 and 122 for liquid movement. A maximum water 112 rise 111 inside capillary tube 110 can determine an upper limit (i.e., fluid level 102) of an unsaturated zone 104 according to the capillary porosity reference, which can also be referred to as a zone of negative fluid pressure potential. If capillary tube 110 were bent downward inside the unsaturated zone 104, it alters the direction of the flow of fluid 109. Beneath the unsaturated zone 104, the fluid movement continues, responding to the fluid matric gradient. It is important to note that each porous system has its own maximum height of upper limit 102 (i.e. fluid level expressed as characteristics of upward unsaturated flow dynamics.

Fluid that moves in a downward direction inside a U-shaped unsaturated siphon 101 can experience an increase in pressure, or a reduction of its fluid matric potential. As the fluid reaches the water table level 103 (i.e., fluid level 103) where the pressure is conventionally zero, the fluid loses its water connectivity and the pull of gravity forces the flow of water in a downward direction, thus increasing its positive pressure until it drains out as indicated respectively by arrows 120 and 125 from the unsaturated siphon 101. If the unsaturated siphon 101 were a real "tube" sealed in the walls, it could fail to work as a reversible unsaturated siphon and posses a functioning very close to that of a common siphon.

Capillary tube 110 can continue to slowly drag additional fluid 109 from container 106 compartment 106) due to an unsaturated gradient, which is sensitive to small losses of evaporation at a capillary meniscus 111. The U-shaped unsaturated siphon 101, however, is more efficient than capillary tube 110 in transferring fluid between two locations having a fluid matric gradient because it can have lateral flow 118 and connect multiple compartments 108 and 107. The unsaturated siphon 101 can cross the compartment 108 and 107 respectively at lateral side 115 and top side 116. If the unsaturated siphon 101 crossed the bottom of compartments 108 and 107, it may perform unwanted saturated flow.

Fluid 109 can continue to move to the point indicated generally by arrows 120 and 125 until the water table level 103 (i.e., fluid level 103) attains the same level in both legs of the upside down U-shaped unsaturated siphon 101, thereby providing a fluid matric balance, which stops fluid flow. Fluid 109 moving as unsaturated flow from container 106 to the point 120 must be able to withstand adhesion-cohesion connectivity forces of suction inside the unsaturated siphon 101. Based on the configuration illustrated in FIG. 1, it can be appreciated that the actual capillary action that occurs based on tubing geometry of FIG. 1 cannot contrive to the U-shaped upside down spatial arrangement depicted in FIG. 1 because its strict geometry leads to a siphoning effect without lateral flow, which spoils the unsaturated flow by downward suction.

Unsaturated siphon 101 therefore constitutes an efficient interface with a high level of anisotropy for longitudinal flow 114 to redistribute fluids responding to fluid matric gradients among different compartments 106, 107, and 108 and a porous media 119 inside the saturated zone 105 and/or unsaturated zone 104, having an efficient lateral flow, as indicated generally by arrows 118, 120, and/or 125. The compartments can possess several spatial arrangements, as uncontained independent units 106 and 107, and/or contained independent units 108 partially inside 107 as depicted at point 113.

The flow rate of water or fluid 109 moving inside the unsaturated siphon 101 from the compartment 106 toward the point 117 at the water table level 103 (i.e. fluid level 103) can be vertically quantified as indicated, for example, by the arrow 123. Then, in order to set standards for a macro scale of spatial unsaturated flow, a specific measurement unit can be defined by the term "unsiphy", which is generally symbolized by the symbol "⊓" (e.g., as the upward penetration of 2.5 cm 123 in the unsaturated zone by the unsaturated siphon 101 just above the hydraulic head or fluid level 103). One or more reversible unsaturated siphons 101 can be assessed in their hydrodynamic characteristics to transmit fluids by the unsaturated hydraulic coefficients expressed as unsiphy units "⊓" representing variable intensities of negative pressure, or suction, applied as unsaturated flow. This variable can also represent a variable cohesiveness of molecules in the fluid to withstand fluid transference in order to bring a fluid matric balance throughout all the extension of the reversible unsaturated siphon.

Figure 2:
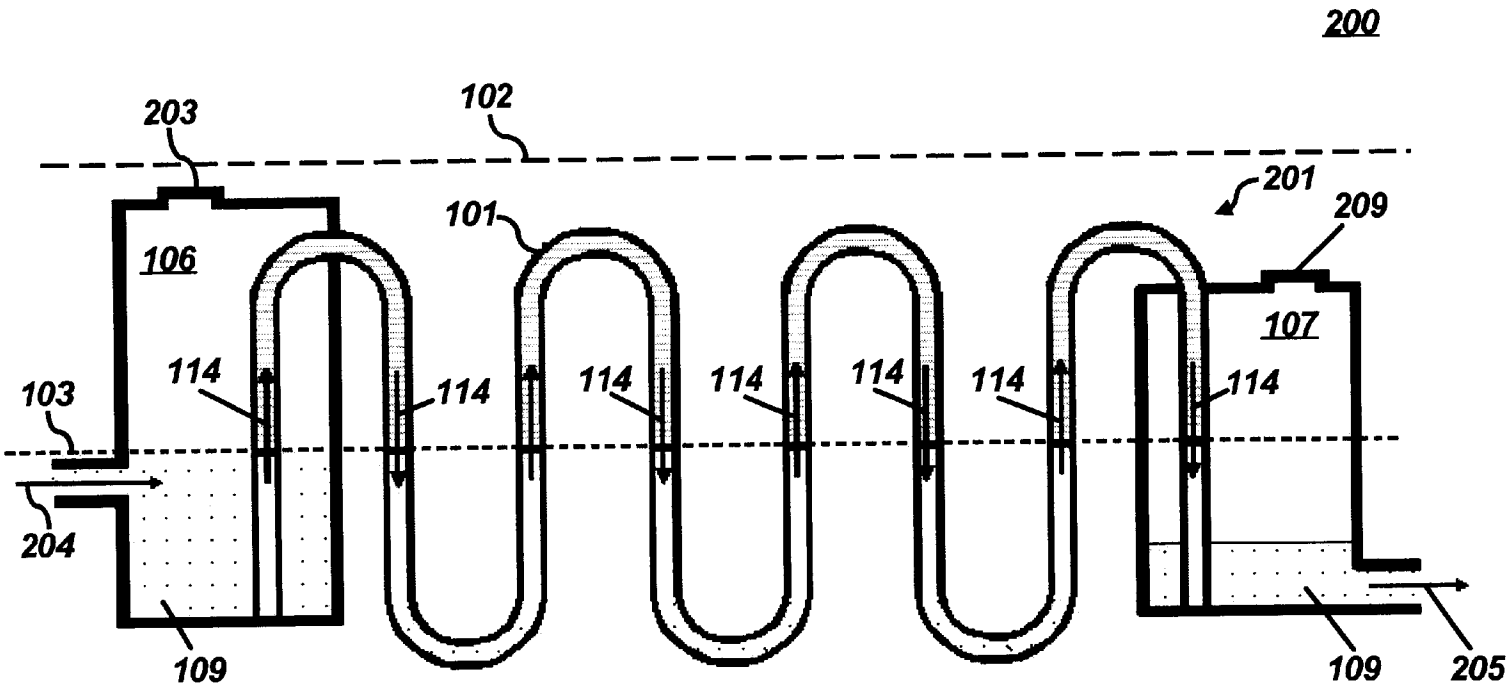
FIG. 2 depicts a cross-sectional view of a hydrodynamic system illustrative of multiple serial continuous cyclic phases of unsaturated siphons having diverse applications associated with an intermittent molecular dragging force in the unsaturated flow connectivity, in accordance with a preferred embodiment of the present invention.

FIG. 2 depicts a hydrodynamic model 200 (i.e., a system 200) illustrative of multiple serial continuous cyclic phases of unsaturated siphons 201 having diverse applications associated with an intermittent dragging force in the unsaturated flow, in accordance with a preferred embodiment of the present invention. In the configuration depicted in FIG. 2, multiple reversible unsaturated siphons 201 can be arranged serially to offer important features for fluid filtering by molecular attraction of unsaturated flow. Fluid 109 can move from a left compartment 106 to a right compartment 107 passing by intermittent dragging force in the unsaturated siphons 101 inside the negative pressure zone between fluid levels 103 and 102. Raising the fluid level 103 in the left compartment 106 can decrease the dragging force in an upward unsaturated flow of fluid 109 in all serial siphons 101 requiring less effort to move from the left compartment 106 to the right compartment 107 affecting flow velocity and filtering parameters. Those skilled in the art can thus appreciate, based on the foregoing, that the unsaturated siphons illustrated in FIG. 2 comprise a series of serially connected siphons, such as the individual siphon 101 of FIG. 1. The system depicted in FIG. 2 can be contained in order to prevent fluid losses that occur due to fluid leakage or evaporation. Fluid 109 input to the container 106 could be manual 203 or automatic 204. Also, fluid 109 output could automatically leave the compartment 107 via the outlet, as indicated by arrow 205. Left container 107 can be configured to possess a lid 203, while the right compartment 107 can be configured to possess a lid 209. Note that in FIGS. 1 and 2, like or analogous parts are indicated by identical reference numerals. Thus, the longitudinal flow 114 of liquid 109 through the siphons 201 is also shown in FIG. 2. Additionally, a single siphon 101 is depicted in FIG. 2, which is analogous to the siphon 101 illustrated in FIG. 1. It can be appreciated by those skilled in the art that a plurality of such siphons 101 can be configured serially to form serially arranged siphons 201.

Figure 3:
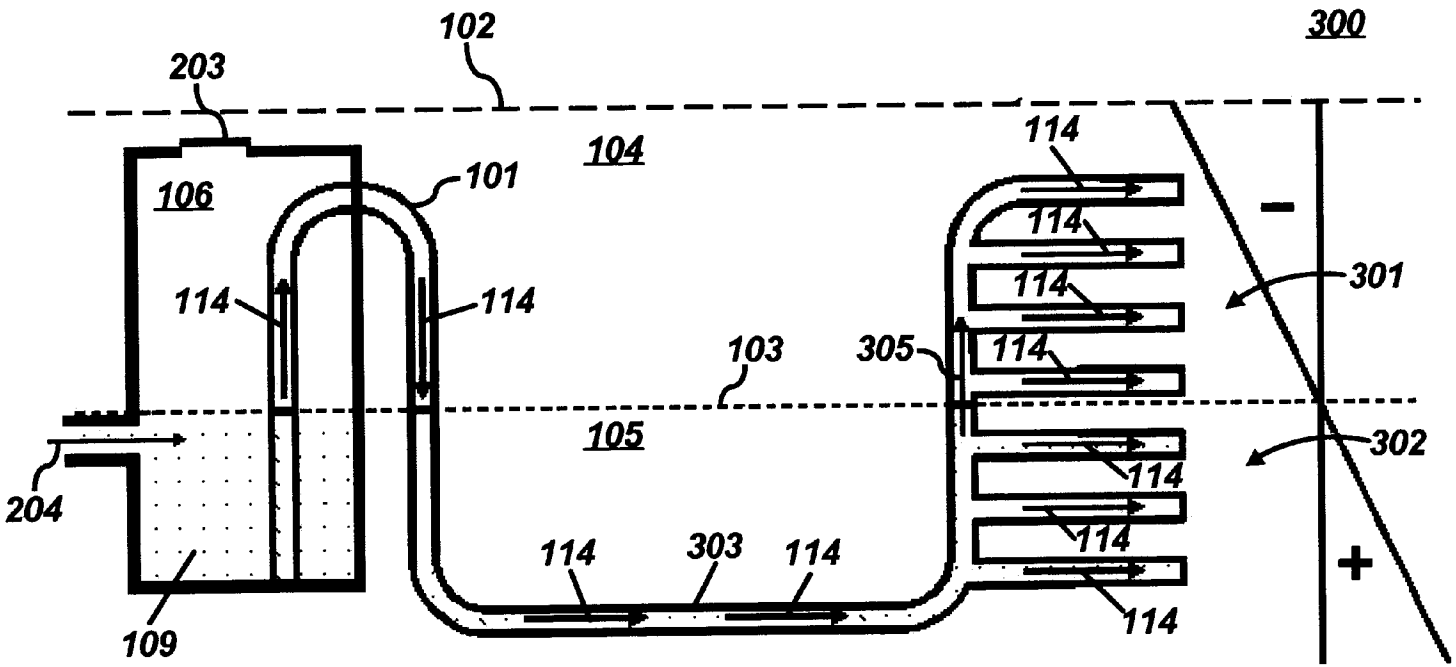
FIG. 3 illustrates a cross-sectional view of a hydrodynamic system in which fluid is supplied to specific sources having optional levels of fluid matric potential adjustable at an outlet, in accordance with an alternative embodiment of the present invention.

FIG. 3 illustrates a hydrodynamic configuration 300 in which fluid 109 is supplied to specific sources having optional levels of fluid matric potential adjustable at an outlet, in accordance with a preferred embodiment of the present invention. A reversible unsaturated siphon 101 can be used to offer fluids at variable fluid matric potential as show in FIG. 3. Fluid 109 thus can generally move from a containment or compartment 106 by the reversible unsaturated siphon 101 according to an unsaturated gradient of water table 103 inside the unsaturated zone 104 and below the upper limit 102 of unsaturated zone 104. Fluid 109 can move optionally as saturated flow from the compartment through the longitudinal section 303 to the supply zones 301 and 302 offering different fluid matric potential according to a specific adjustable need. The fluid travels horizontally in the reversible unsaturated siphon 101 through saturated zone 105, which is represented by a positive "+" symbol in FIG. 3. Note that as depicted in FIG. 3, unsaturated zone 104 is represented by a negative "-" symbol. Note that reference numeral 304 in FIG. 3 represents an optional height outlet. The water 109 rise in the unsaturated siphon as depicted at arrow 305 can offer important features, such as, for example, fluid filtering, easy removal by molecular attraction to the enhanced porosity of the conductor, the clogging factor for fluid delivery.

Figure 4:
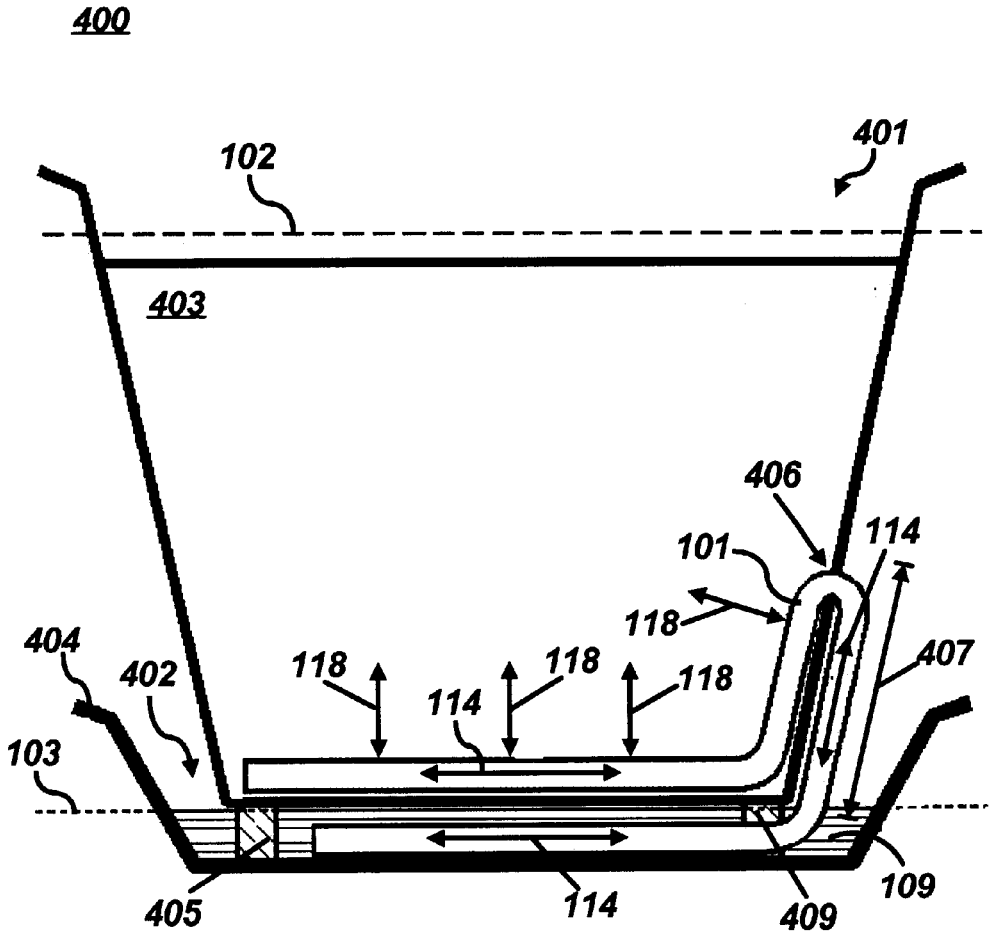
FIG. 4 depicts a cross-sectional view of an enhanced hydrodynamic system, which is applicable to common pots of ornamental plants in which water can be supplied optionally at the top or bottom bearing a never clogging characteristic, in accordance with an alternative embodiment of the present invention.

FIG. 4 Depicts a cross-sectional view 400 illustrative of a highly enhanced hydrology applied to common pots for ornamental plants. The reversible unsaturated siphon 101 provides an ideal interface to move water reversibly between the saucer 404 and the pot 403. This common pot attains a characteristic of never clogging because excessive water, saturated water 105 is removed continuously until all extent of the unsaturated siphon attains a fluid matric balance.

The hydrologically enhanced pot 403 can receive water via a top location 401 or a bottom location 402. The pot 403 does not contain draining holes at the bottom location 402. Consequently only water 109 is removed from the pot, thereby preventing losses of rooting media material, which is often a source of environmental pollution. The unsaturated siphon 101 also promotes filtering as illustrated in FIG. 2 because of a reduction in the bearing weight as water moves under suction. Losses of nutrients by leaching are highly minimized. The embodiment depicted in FIG. 4 can also contribute to improvements in the use of water resources, because the excessive water transferred as indicated by one or more arrows 118 from the granular porous material in the pot 403 by the unsaturated siphon 101 and deposited temporarily in the saucer 404 can be utilized again whenever the fluid matric gradient changes direction. Also, most of the nutrients leached in the unsaturated flow can return in solution to the pot 403 for plant use The height of the water table 103 (i.e., fluid level 103) in the saucer 404 can be regulated by the pot support legs 405 and 409, thereby providing room for water deposit and the unsaturated siphon 101. The unsaturated siphon 101 can have a different configuration and be hidden inside the pot walls or pot body. If water is refilled in the bottom 402, it will consider the maximum water rise by unsaturated flow in the upper limit 102 (i.e., fluid level 102). Note that arrow 407 generally indicates the height of the siphon insertion, which can be standardized in unsiphy units. It can be appreciated by those skilled in the art that a single pot 403 can be configured with a plurality of unsaturated siphons 101.

Figure 5:
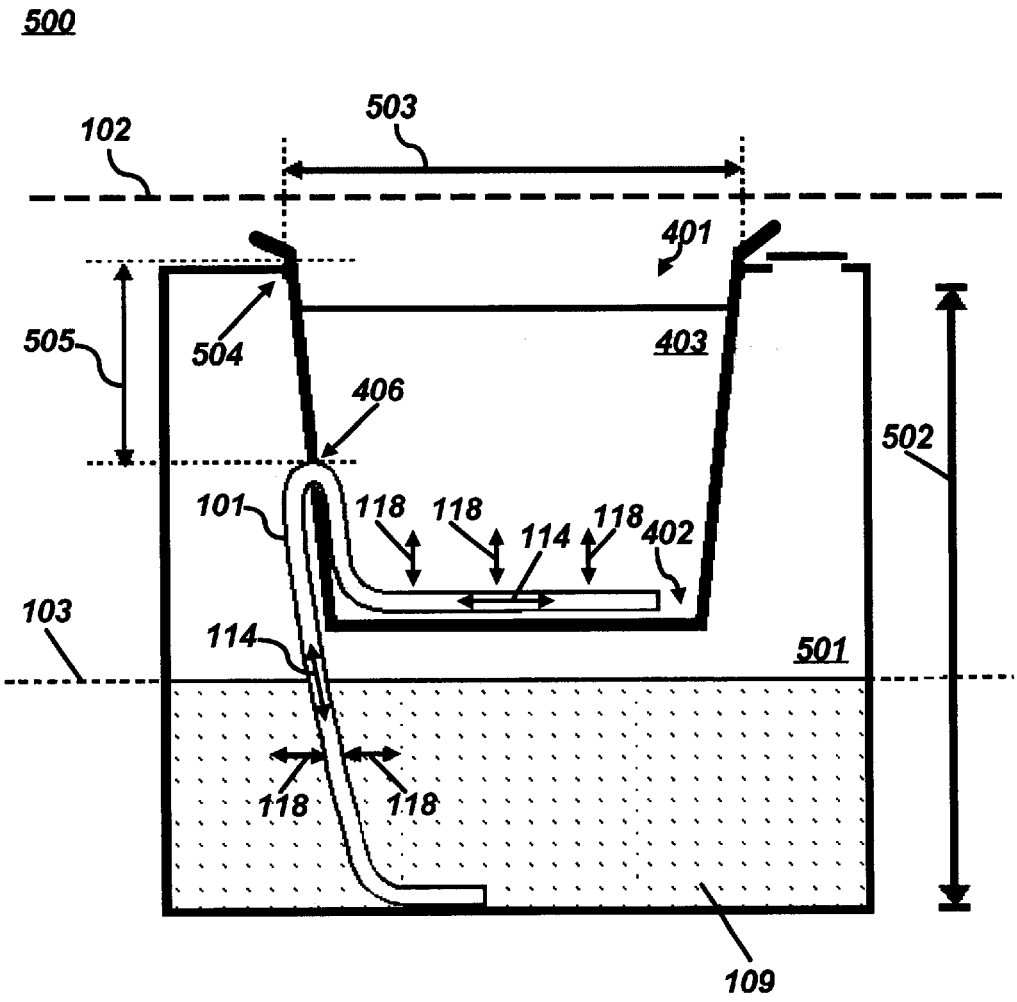
FIG. 5 illustrates a cross-sectional view of an enhanced hydrodynamic system, which is applicable to common pots of ornamental plants becoming optionally self-sustaining by using a larger compartment for water storage instead of a saucer, in accordance with an alternative embodiment of the resent invention.

FIG. 5 illustrates a cross section view of an enhanced hydrodynamic system 500 which is applicable to common pots of ornamental plants that are optionally self-sustaining through the use of a larger compartment 501 for water storage instead of the saucer 404, which was initially illustrated in FIG. 4. As depicted in a FIG. 5, a water compartment storage 501 (i.e., a fluid compartment) can be totally or partially semi-transparent in order to allow visual perception of the water level 103. A water refill operation can be performed reversibly en at the top location 401 or at the bottom location 402. If water is refilled at the bottom location 402, the water may achieve a maximum fluid level as indicated by arrow 502, thereby reversing the longitudinal flow 114 and achieving a temporary saturated condition for the rooting compartment, which is important for re-establishing unsaturated flow connectivity.

In FIG. 5 arrow 503 represents the diameter of the top circle of the rooting compartment 403, while reference numeral 504 indicates the attachment of fluid compartment 501 and rooting compartment 403. Additionally, reference numeral 505 indicates an extension of attachment range. The diameter indicated by arrow 503 can be standardized in unsiphy units. A single pot 501 can be configured with multiple unsaturated siphons 101. The size of the water storage compartment 501 can determine the frequency of water refill operations. Maintaining standard dimensions in the rooting compartment 403 (i.e., top portion of rooting compartment 403), can result in the development of many water deposits offering varying levels of water supply and aesthetic formats. An attachment 504 of the rooting compartment 403 to the water storage compartment 501 does not need to be located at the top of the rooting compartment 403. The attachment 504 can occur in any part 505 between the insertion of the unsaturated siphon 101 and the top of the rooting compartment 403. Larger sizes can suggest lower attachments because of increased physical dimensions.

Water or fluid 109 in the compartment 501 can be sealed to prevent evaporation losses and to curb proliferation of animals in the water, which might be host of transmissible diseases. In Brazil, for example, approximately 60% of Dengue spread by the mosquito Aedes aegyptii is associated with stagnant water of ornamental plants pots. The common pots depicted in FIG. 4 and FIG. 5 offer self-sustaining characteristics and conditions for the supply of water and nutrients to plant roots with minimum losses.

Figure 6:
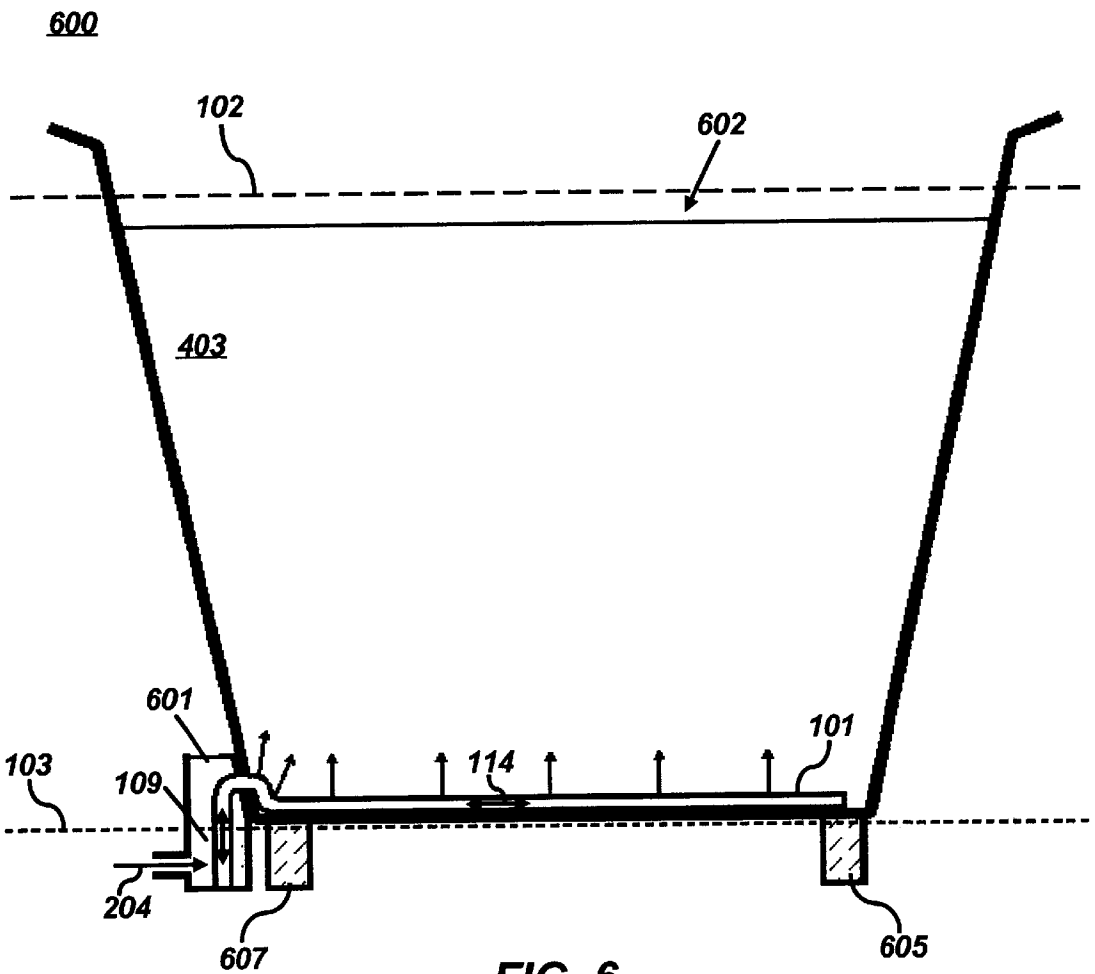
FIG. 6 depicts a cross-sectional view of a hydrodynamic system, which is applicable to planters having self-sustaining features and automatic piped water input, in accordance with an alternative embodiment of the present invention.

FIG. 6 depicts a cross-sectional view of a hydrodynamic system 600, which is applicable to planters having self-sustaining features and automatic piped water input. System 600 can be adapted, for example, to commercial areas where maintenance due to water supply is expensive. Water can be supplied continuously from a pipe system to a small compartment 601 as indicated by arrow 204. Water can move continuously via the unsaturated siphon 101 to the rooting compartment of the planter 403 as required by the plant. It is important to consider the maximum water rise 102 (i.e., fluid level 102) in the rooting compartment. Water 109 can move continuously by unsaturated flow responding to the fluid matric gradient in the entire unsaturated siphon 101. Whenever water is required in the planter 403, water can move from the unsaturated siphon 101 as lateral flow to attend fluid matric gradient. A single pot 501 can be configured with a plurality of unsaturated siphons 101. Optional devices for a constant hydraulic head can be employed, for example, such as a buoy. Additionally, changing the size of the planter feet 605 and 607 controlling the height of the water compartment 601 can control the desired height of the water table 103 (i.e., fluid level 103). Periodically watering top 602 of pot 403 can rescue unsaturated flow as well remove dust and prevent salt buildup in the top surface of the planter as result of continuous evaporation and salt accumulation thereof.

Figure 7:
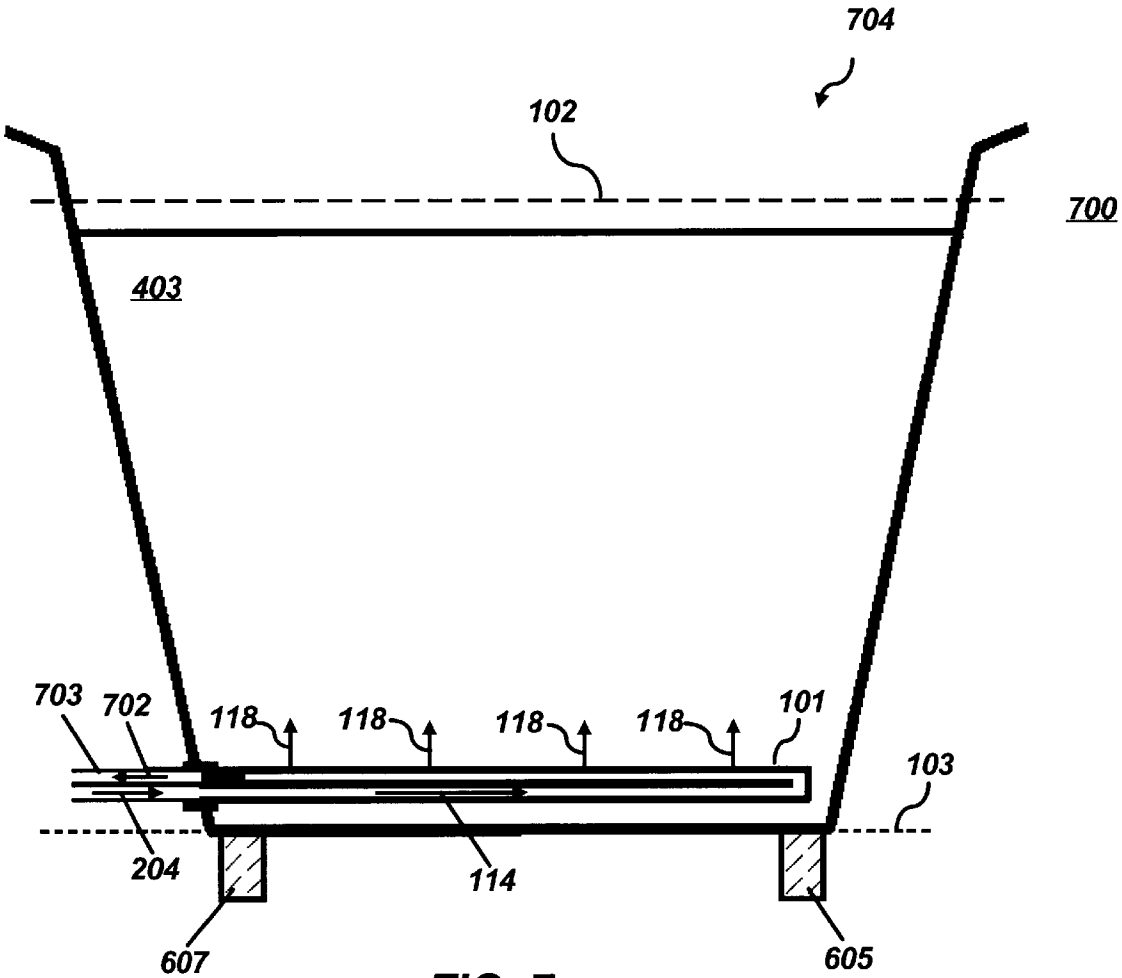
FIG. 7 illustrates a cross-sectional view of a hydrodynamic system, which is applicable to planters having self-sustaining features and automatic piped water input operating under saturation/unsaturation cycling, in accordance with an alternative embodiment of the present invention.

FIG. 7 illustrates a cross-sectional view of a hydrodynamic system 700, which is applicable to planters 700 having self-sustaining features and automatic piped water input working under saturation/unsaturation cycling controlled by electronic sensors of fluid matric potential and variable speed reversible pumps. A double-way pipe system can offer water 204 and remove it 702 in a circular way that offers water under pressure and/or suction. Water moves 3>1 to and from the planter by common pipes 703. The reversible unsaturated siphon 101 can possess a linear format that connects saturated and unsaturated zones and promotes water movement according to the fluid matric gradient. Water can be offered initially as saturated condition in the watering cycle as indicated by arrow 204. The pump work changes from pushing as at indicated at arrow 204 to pulling as indicated by 702, thereby changing the pipe flow from positive pressure to negative pressure or suction whenever an associated electronic control center (not illustrated herein) demands unsaturated conditions in the pot 403. The excessive saturated water can be removed, or water can be continually offered as negative pressure by suction. Periodically watering the top location 704 can rescue unsaturated flow as well as remove dust and prevent salt buildup in the top surface of the planter as a result of continuous evaporation and salt accumulation thereof.

Figure 8:
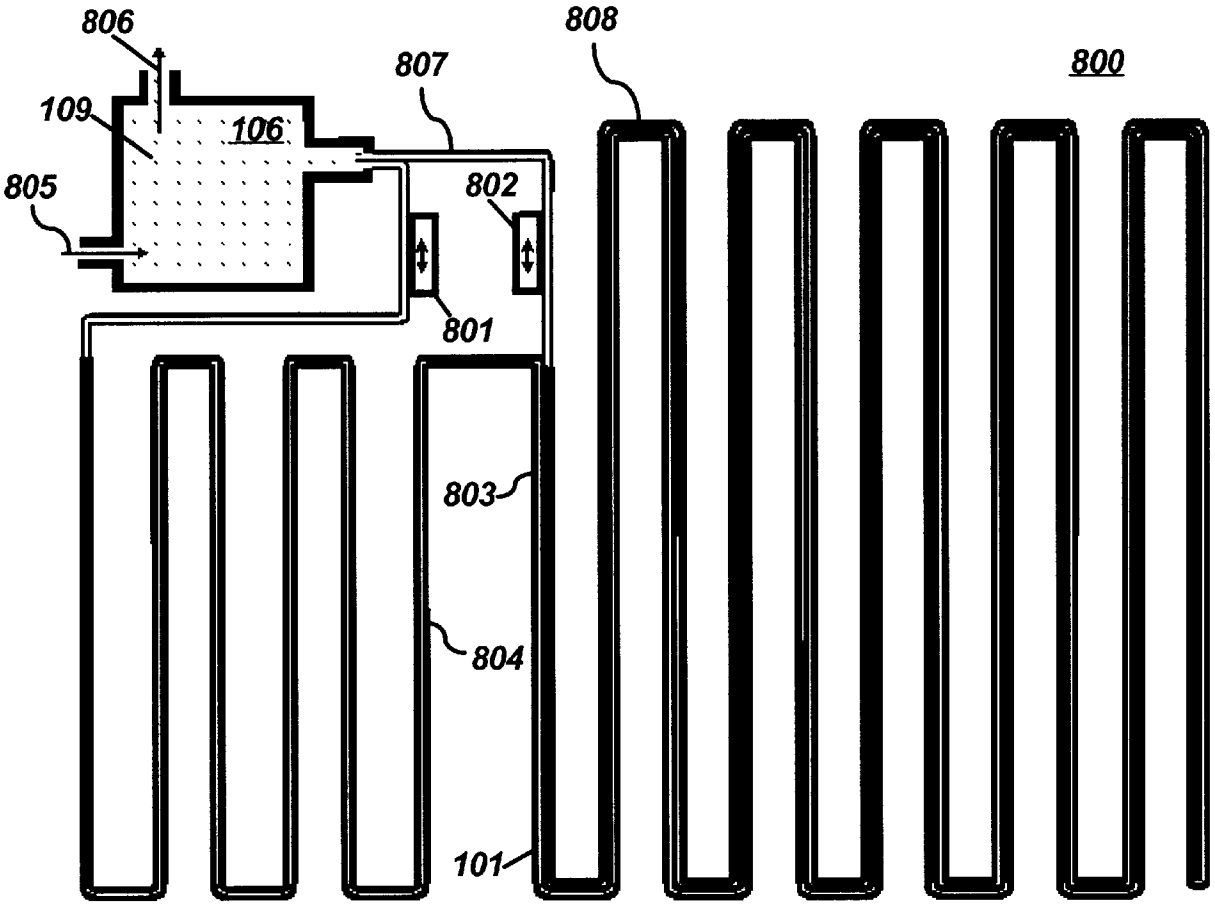
FIG. 8 depicts a cross-sectional view of a hydrodynamic system, which is applicable to field irrigation/drainage operating with a unique pipe system having two-way directional flow and automatic piped water input/output under saturation/unsaturation cycling, in accordance with an alternative embodiment of the present invention.

FIG. 8 depicts a horizontal cross-sectional view of an enhanced hydrodynamic system 800, which is applicable to field irrigation/drainage in association with a unique pipe configuration having two-way directional flow and automatic piped water input/output under saturation/unsaturation cycling. Water 109 can move to or from the compartment 106 to the open field by a pipe system, which can offer or drain the water according to unsaturated conditions.

Two variable speed reversible pumps 801 and 802 can offer fluid or water 109 initially by pushing the fluid or water 109 to the pipes to establish molecular connectivity in one or more unsaturated siphons 101. There are two kinds of pipes, a regular pipe 807 to move water to and from water deposit 106 (i.e., compartment 106) connected to an unsaturated siphon pipe 808. System 800 can be equipped with a unique pipe 804 for water distribution or as double pipes 803 for close water distribution. Because system 800 does not operate under gravity conditions, the siphons do not necessarily need to be configured with an upside-down "U" shape, but essentially If water 109 supply is aimed, it can initially offer water by saturated condition having one pump or both pumps 801 and 802 pushing and/or pulling. Then, to keep unsaturated condition inside the pipes, only one pump can pull the water, making a hydraulic cycling system almost similar to that inside animal circulatory system of mammals. Both pumps 801 and 802 can work alone or together, pulling and/or pushing, to attain water connectivity inside the pipes with a specific aimed water matric potential in order to promote irrigation or drainage in the system. When irrigation operation is aimed, the high fluid matric gradient in the granular soil around the pipes can attract unsaturated water from the pipe wall, which was pumped from 805. Electronic sensors (not pictured) located near the pumps 801 and 802 can provide information about the status of the fluid matric potential in the pipes entering and leaving the system in order to keep it working continuously under a safe functioning range of unsaturation. Mechanical control also is possible by controlling the water input/output status level in the water deposit 106.

When the drainage operation is attained, the saturated conditions about the pipes can permit water to be drained via unsaturated flow moving inside the pipes. The water can then exit system 800, as indicated by arrow 806. Once the connectivity is attained, the pumps 801 and 802 can pull both together for drainage operation. Electronic pressure sensors (not pictured), which may be located in at least one common pipe 807 near the pumps 801 and 802 can be utilized to detect variation in the fluid matric potential to provide information to a computerized center (not shown in FIG. 8) for controlling the speed and reversibility of the pumps in order to provide the aimed functioning planed task, which is based on fluid continuous connectivity.

Embodiments of the present invention can be designed to operate in conditions different from natural gravity pull, which can require the use of an upside-down "U" shape to vertically separate the saturated zone from the unsaturated zone. Embodiments of the present invention can be utilized to reduce environmental nonpoint source pollution, because water is offered under demand and is generally prevented from leaching to groundwater as saturated flow. The irrigation operation can also be appropriate for sewage disposal offering the advantage of full-year operation because the piping system runs underground preventing frost disturbance and controlling water release to curb water bodies contamination. A golf course, for example, can utilize this system for irrigation/drainage operations when implemented in the context of an unique underground arrangement.

Figure 9:
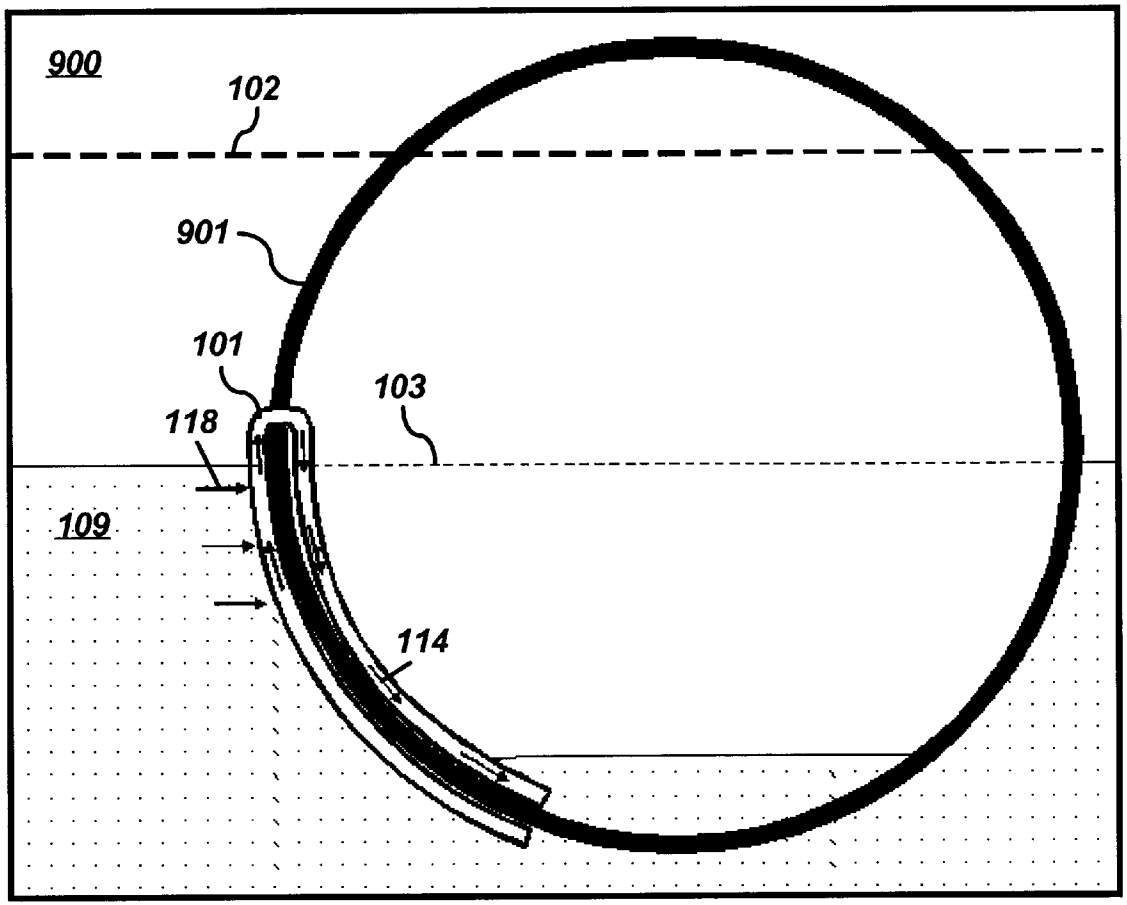
FIG. 9 illustrates a cross-sectional view of a hydrodynamic system, which is applicable to molecular drainage having self-draining features by molecular attraction of unsaturated flow conceptions, in accordance with an alternative embodiment of the present invention.

FIG. 9 illustrates a cross-sectional view of a hydrodynamic modeling application 900 to molecular drainage having self-draining features by molecular attraction of unsaturated flow conceptions working under gravity pull. This application is appropriate mainly for large pipes or draining ditches. Water 109 moves from outside the tube or wall by unsaturated siphon 101, which can be multiple and inserted in several parts of the wall between the top and the bottom of the draining structure, but preferably in a middle section. Water 109 moves from the saturated zone 105 situated lower the water table 103 by a fast lateral flow 118 and longitudinal flow 114 entering the unsaturated siphon 101 and draining out 120 at the lower portion. The unsaturated siphon 101 is a very efficient porous structure to remove water as unsaturated flow because of adhesion-cohesion in the fluid leading to ensured draining operations, which operate reliably by molecular attraction rarely clogging nor carrying sediments and minimum solutes associated to the dragging structure. Water drained by unsaturated flow is generally filtered because of an increasing reduction of its bearing weight as water penetrates upward in the negative matric potential zone. Unsaturated flow having a negative water matric potential becomes unsuited to carry suspended particles or heavy organic solutes. The property of "rarely clogging" can be attained because water is drained by a molecular connectivity in chains of fluid adhesion-cohesion and its attraction to the enhanced geometrical of microporosity.

Figure 10:
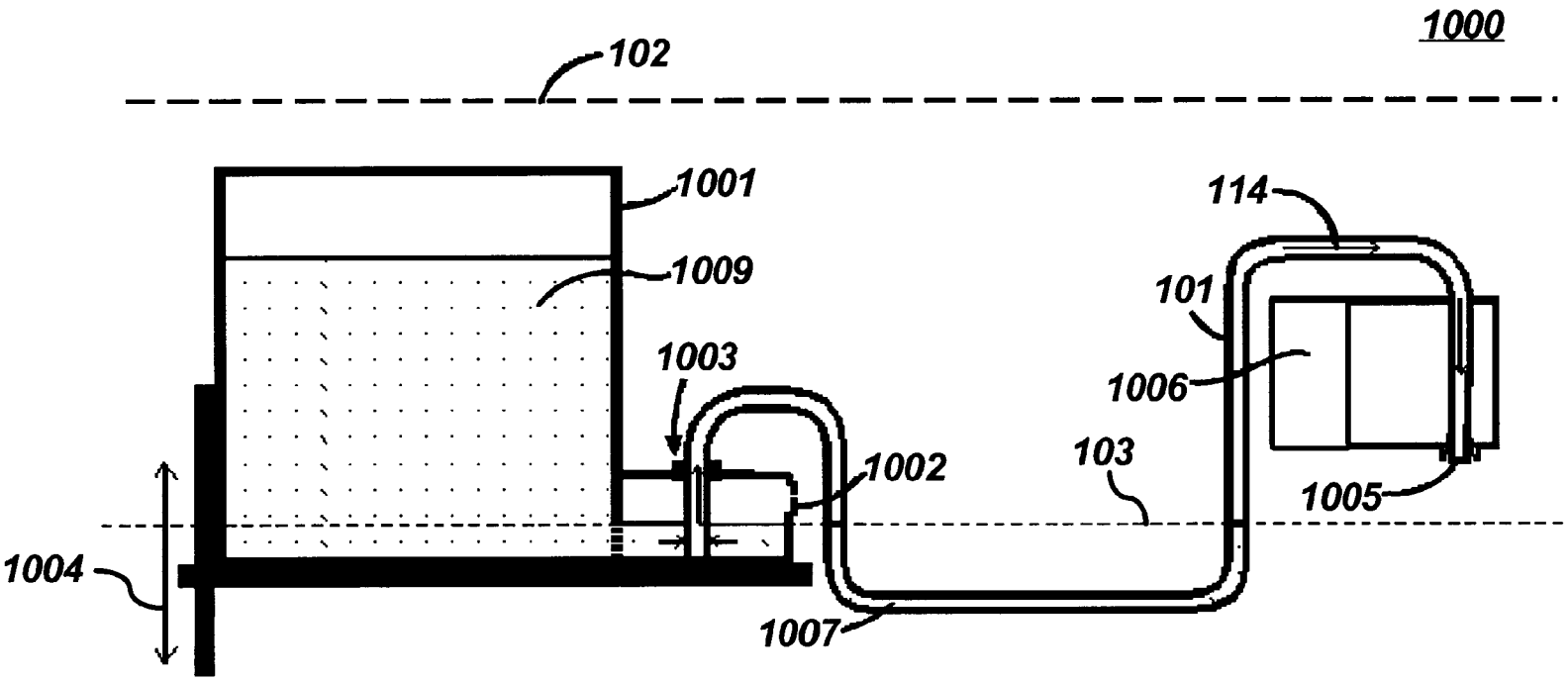
FIG. 10 depicts a cross-sectional view of an enhanced hydrodynamic system, which is applicable to printing technology having self-inking features with adjustable fluid matric potential supply, in accordance with an alternative embodiment of the present invention.

FIG. 10 depicts a cross-sectional view of an enhanced hydrodynamic system 1000, which is applicable to printing technology having self-inking features with adjustable fluid matric potential supply. The fluid 1009 at constant hydraulic head 103 can move from the compartment 1001 passing through the unsaturated siphon 101 and offered at any adjustable point 1005 height with a controlled fluid matric potential. Optional devices for constant hydraulic head can be employed, for example, such as a buoy. System 1000 can also be equipped with a practical regulating device 1004 with a variable height to change the status of fluid matric potential delivery. This means that; the user can achieve a printout with more ink released or less ink released, thereby preventing fading or blurring conditions in the printout. The alternative embodiment of present invention illustrated in FIG. 10 offers a special feature to users, which permits such users to tune, at their will, the fading characteristic of printouts. Also, cost reduction in the printing technology can drop to the ink cost level, while offering a lengthened life and enhanced color for printing.

A device 1006 can be configured as an ink cartridge for ink release (e.g., ribbon cartridges). A lid 1002 can rotate the ink deposit 1001. When lid 1002 is open, ink may be refilled through the opening associated with lid 1002. The unsaturated siphon 101 is generally connected to the ink deposit 1001. The longitudinal flow 114 for ink delivery can be sufficient to attend the ink flow velocity requirements according to each printing device. Ink moving longitudinally 1007 through unsaturated siphon 101 by saturated flow can move be faster if a larger flow velocity is required. The unsaturated siphon 101 can be configured according to a structure comprising a plurality of unsaturated siphons and can be configured with a cylindrical microstructure for delivering the ink directly to the printing media or to an intermediary application device.

Figure 11:
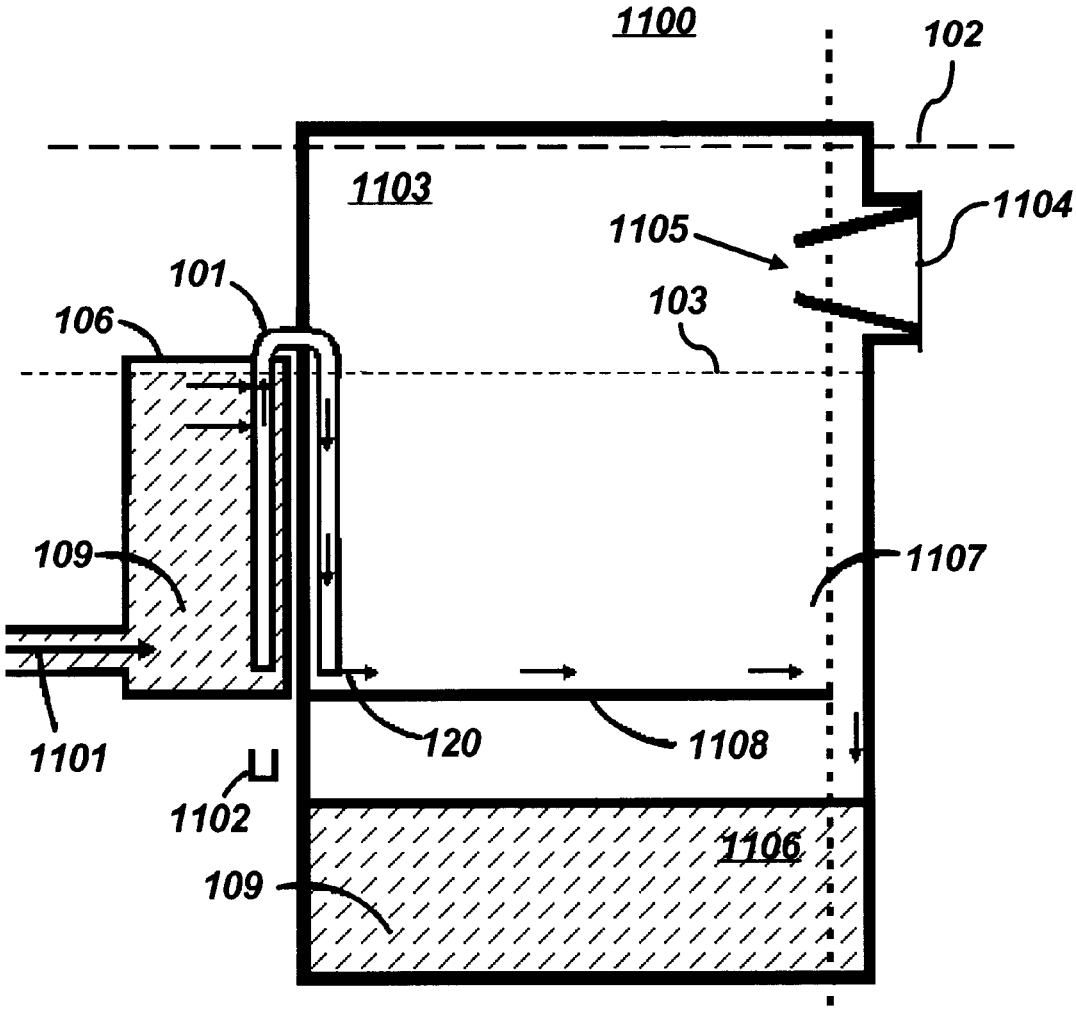
FIG. 11 illustrates a cross-sectional view of a hydrodynamic system, which is applicable to rechargeable inkjet cartridges having self-controlling features for ink input, in accordance with an alternative embodiment of the present invention.

FIG. 11 illustrates a cross-sectional view of a hydrodynamic system 1100, which is applicable to rechargeable inkjet cartridges having self-sustaining features for ink input. Fluid 109 (e.g., ink) can move from the deposit 106 to the inkjet cartridge 1103 at a steady continuous unsaturated flow, passing through the unsaturated siphon 101. In accordance with an alternative embodiment of the present invention, fluid 109 (e.g., ink) can move first to the unsaturated zone 1107 having a foam structure 1105 leaving the unsaturated siphon 101 as indicated by arrows 120 and 125. The fluid 109 can continue to move toward the saturated compartment 1106 due to the force of gravity. The internal dimensions of the cartridge 1103 compartments can be altered to increase the ink capacity by expanding the saturated ink deposit 1106 and reducing the size of the unsaturated ink compartment 1107. The tip of the external leg of the unsaturated siphon 1102 can be replaced after a refilling operation to prevent leakage at the bottom of the foam 1105 during transportation. Also, a sealing tape 1104 can be utilized for refilling operations in order to prevent leakage when returning the cartridge to the printer. The printer can receive a self-inking adapter having features similar to the configuration illustrated in FIG. 10 and the ink can be delivered directly where required.

Ink can be provided from an outside source as indicated by arrow 1101. Such an outside source can provide continuous flow input to the ink deposit 109, while maintaining a constant hydraulic head 103 and/or fluid level. Different levels of ink 109 can be delivered to the ink cartridge 1103 by any external device that changes the hydraulic head 103 and/or fluid level. Appropriate handling according to each kind of ink cartridge can be taken care of in order to reestablish the ink refill similar to the manufacturing condition regarding the fluid matric potential. During printing operations, the unsaturated siphon tip 1102 can be removed to operate as an air porosity entrance, even it does not appear to be necessary, because ink delivery is accomplished as unsaturated condition at 1105 and an air entrance is allowed from the bottom. Other positional options for refilling cartridges can be employed, such as, for example, an upright working position, where the unsaturated siphon 101 is inserted on top in order to let the ink move to a specific internal section.

Figure 12:
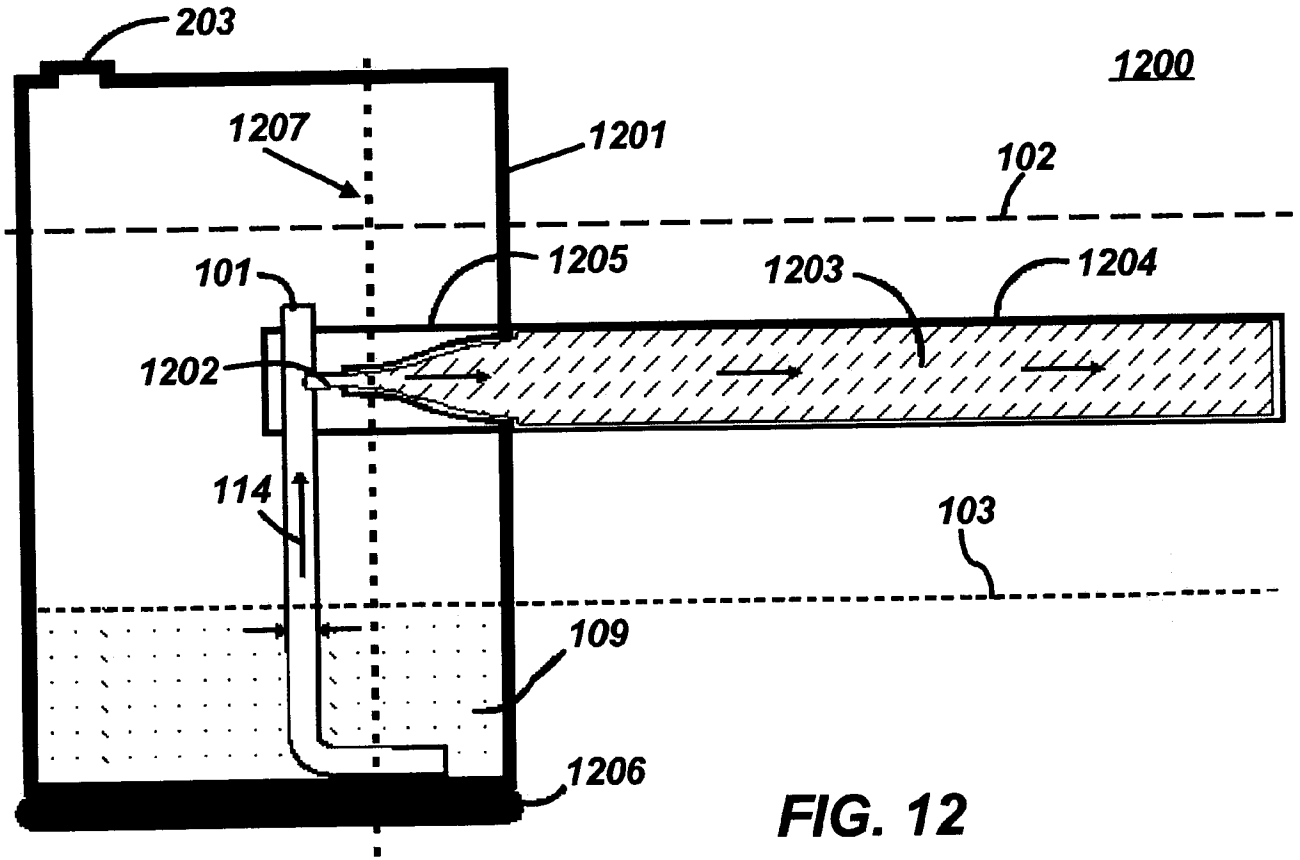
FIG. 12 depicts a cross-sectional view of a hydrodynamic system, which is which applicable to pens and markers with self-inking and ink recharging features for continuous ink input having a never fainting characteristic, in accordance with an alternative of the present invention.
Figures 19A, 19B, 19C:
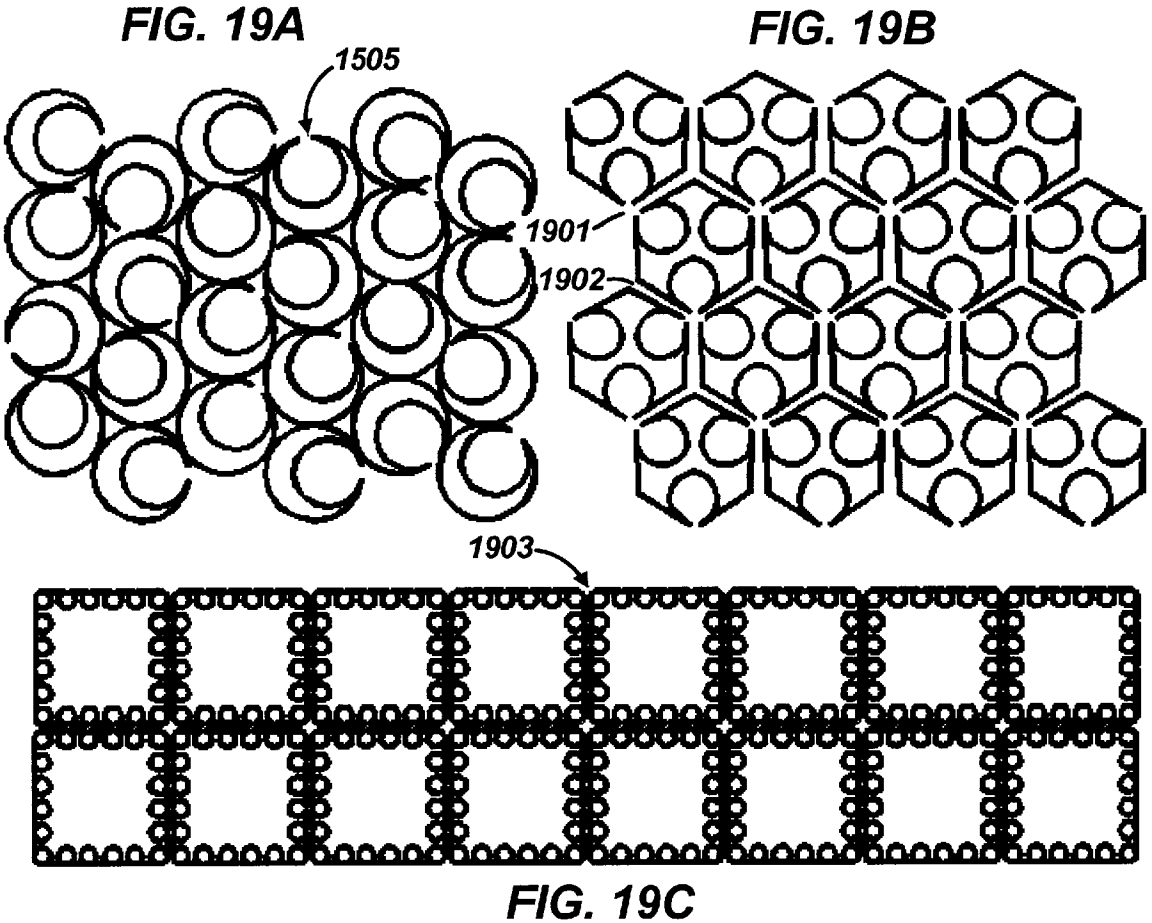
FIG. 19A depicts a cross-sectional view of a spatial geometry of cylindrical fibers with a unique standard tubarc in multiple bulky arrangement, in accordance with a preferred embodiment of the present invention.
FIG. 19B illustrates a cross-sectional view of a spatial geometry of hexagonal fibers with three standard tubarcs in multiple bulky arrangement, in accordance with a preferred embodiment of the present invention.
FIG. 19C depicts a cross-sectional view of a spatial geometry of squared fibers with multiple standard tubarcs in multiple bulky arrangement, in accordance with a preferred embodiment of the present invention.

FIG. 12 depicts a cross-sectional view of a hydrodynamic system 1200, which is applicable to pens and markers with self-inking and ink recharging features for continuous ink input having a never fainting characteristic. Markers and pens 1204 can be recharged in one operation, or continuously by a device disclosed in this invention. Fluid 109 can generally move from the deposit 1201 specially designed to make the contact between the writing tool 1204 with the unsaturated siphon 101 at the point 1202. The container 1201 can be refilled through the lid 203. The porous system 1203 can have the special porosity similar to the unsaturated siphon 101 having high fluid retention or can be empty as illustrated in FIGS. 19A and 19B.

Optionally, one or more simple layers of soft cloth material 1206 can be attached to the sides of the rechargeable device 1200 to operate as erasers for a glass board having a white background. The size of the ink deposit 1201 can change accordingly to improve spatial features, handling, and functioning. Additionally, FIG. 12 illustrates an optional eraser pad 1206 for use in portable systems thereof. The water table may be present if the device (i.e., optional erase pad 1206) is turned 90 degrees clockwise for ink recharging operations. The device 1200 can be utilized to recharge pens and markers at any level of ink wanted by turning the device clockwise, up to 90 degrees. As the device turns, the end of the writing tools 1204 moves downward within the saturated zone and the amount of ink can be controlled by the angle of turning. If the device 1204 is turned 90 degrees clockwise; the ink level as shown at dashed line 1207 can allow for the maximum ink refill operation.

Figure 13B:
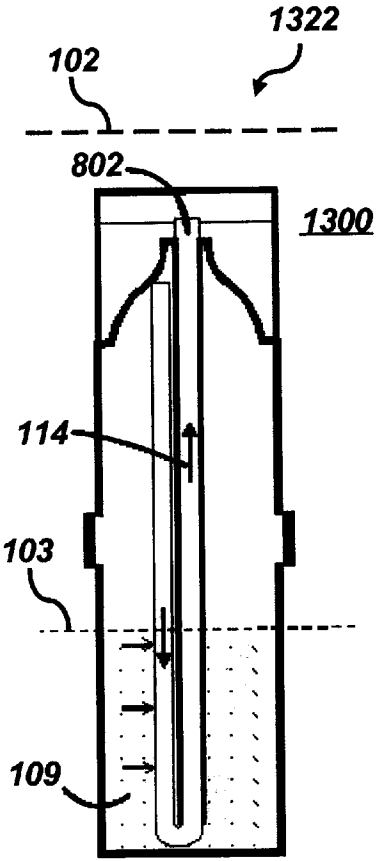
FIG. 13B illustrates a cross-sectional view of an enhanced hydrodynamic system, which is applicable to self-inking self-recharging to-pen and marker functions having a practical ink recharge bearing self-sustaining features for continuous ink delivery in an upside-down position, in accordance with an alternative of the present invention.
Figure 13A:
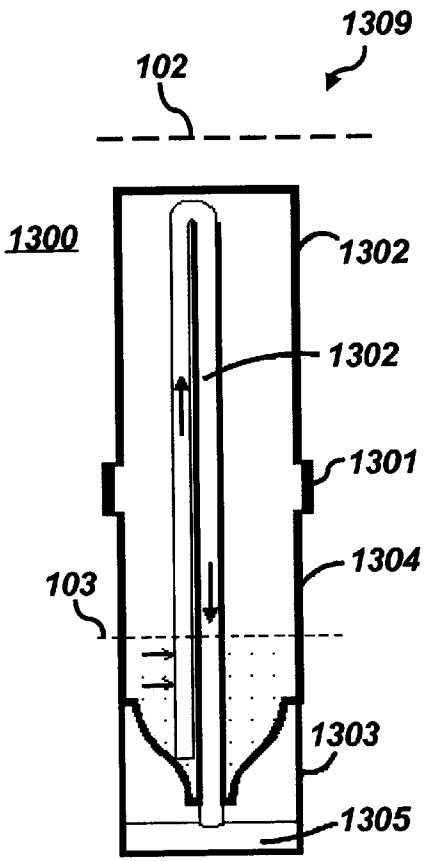
FIG. 13A illustrates a cross-sectional view of an enhanced hydrodynamic system, which is applicable to of self-inking, self-recharging pen and marker functions having a practical ink recharge bearing self-sustaining features for continuous ink delivery in an upright position, in accordance with an alternative of the present invention.

FIGS. 13A and 13B illustrate a cross-sectional view of an enhanced hydrodynamic system 1200, which is applicable to self-inking pens and markers having ink recharge bearing self-sustaining features for continuous ink delivery in respective upright and upside-down positions 1309 and 1322. Fluid 109 (e.g., ink) can be located in the deposit compartment formed by two parts 1302 and 1304, and can move continuously as unsaturated flow toward the writing which is applicable to self-inking pads having a continuous ink recharge with self-sustaining features for continuous ink delivery at the pad. Fluid 109 moves from the container 1401 through the unsaturated siphon 101 in a continuous supply 114 to the inkpad 1403. Ink can be prevented from evaporating by use of a lid 1402. The movement of a hinge 1404 can open lid 1402, for example. The lid 203 can refill ink, if the container 1401 is transparent or semi-transparent, ink refill operation can easily be noticed before the level 103 goes to the bottom of the container 1401. This application offers advantages of preventing spills when inking common inkpads because user does not have control on the quantity of ink that the pad can absorb. Similar industrial applications of inkpads can be developed using the principles disclosed in this application.

Leakage can be controlled by the internal suction in the ink compartment that builds up as fluid is removed or by unsaturated flow velocity. Some prototypes have shown that the suction created by the removal of the fluid do not prevent ink release due to the high suction power of the porosity. If necessary, an air entrance can be attained by incorporating a tiny parallel porosity configuration made of hydrophobic plastic (for water base ink solvents), such as the plastics utilized for water proof material. Also, the compartment 1302 can be opened to let air in if the ink release is impaired. Since the pens and markers tips can have an external sealing layer 2303, then a soft rubber layer 1305 in the bottom of the caps 1303 can prevent leakage by sealing the tip of the writing tools when not in use. Fluid refill operation can be done detaching the upper part 1302 from the lower part 1304 by the attaching detail 1301. System 1300 is generally useful for writing tools that require a high demand of ink (e.g., markers), and which are rechargeable. Optional sealed pens and markers can be refilled by a similar system used to refill ink cartridges or a recharger, from the tip or having an attached unsaturated siphon.

Figure 14:
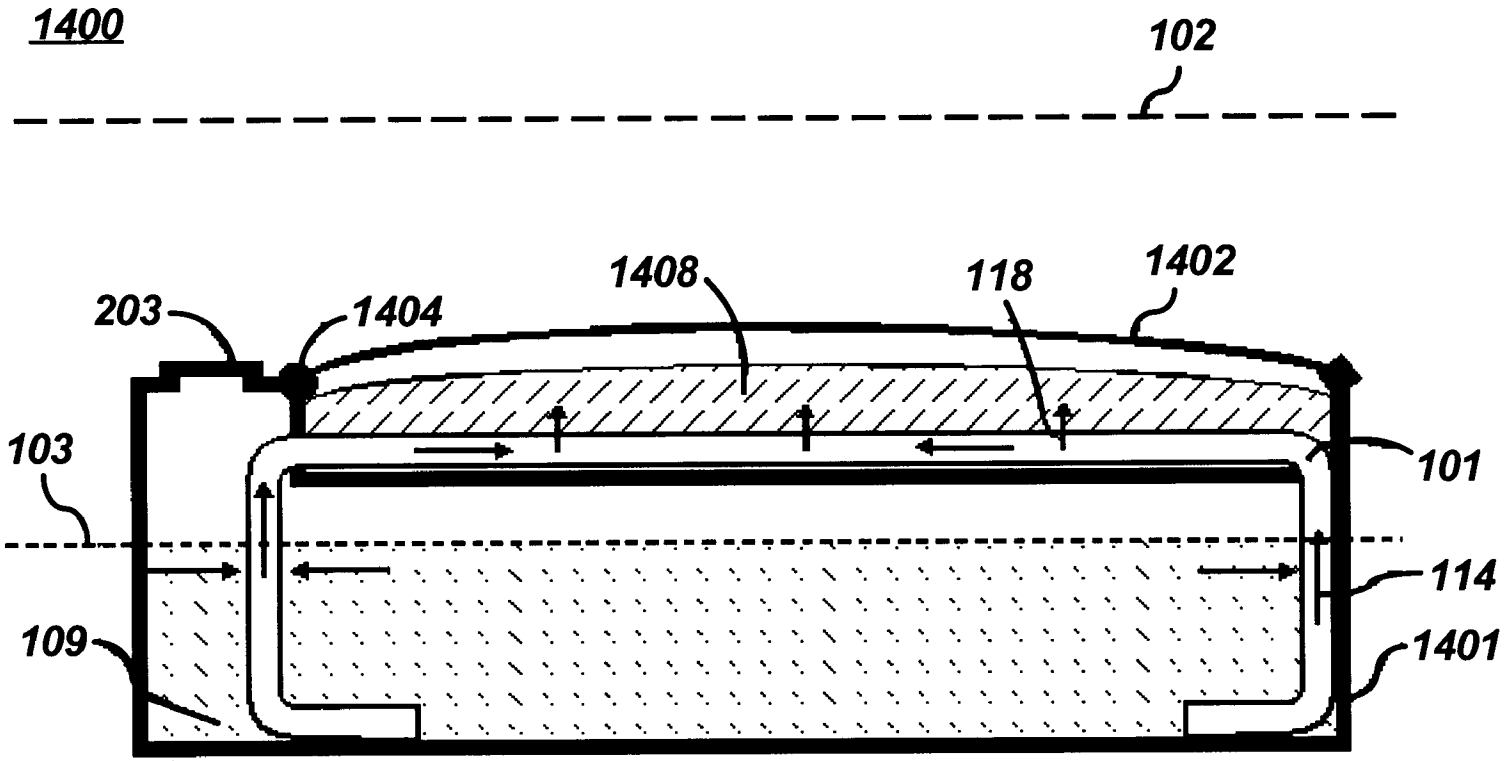
FIG. 14 depicts a cross-sectional view of an enhanced hydrodynamic system, which is applicable to a self-inking pad functioning having a continuous ink recharge with self-sustaining features for continuous ink delivery, in accordance with an alternative of the present invention.

FIG. 14 depicts a cross-sectional view of an enhanced hydrodynamic system 1400, which is applicable to self-inking pads having a continuous ink recharge with self-sustaining features for continuous ink delivery at the pad. Fluid 109 moves from the container 1401 through the unsaturated siphon 101 in a continuous supply 114 to the inkpad 1403. Ink can be prevented from evaporating by use of a lid 1402. The movement of a hinge 1404 can open lid 1402, for example. The lid 203 can refill ink, if the container 1401 is transparent or semi-transparent, ink refill operation can easily be noticed before the level 103 goes to the bottom of the container 1401. This application offers advantages of preventing spills when inking common inkpads because user does not have control on the quantity of ink that the pad can absorb. Similar industrial applications of inkpads can be developed using the principle disclosed in this applications.

Figure 15:
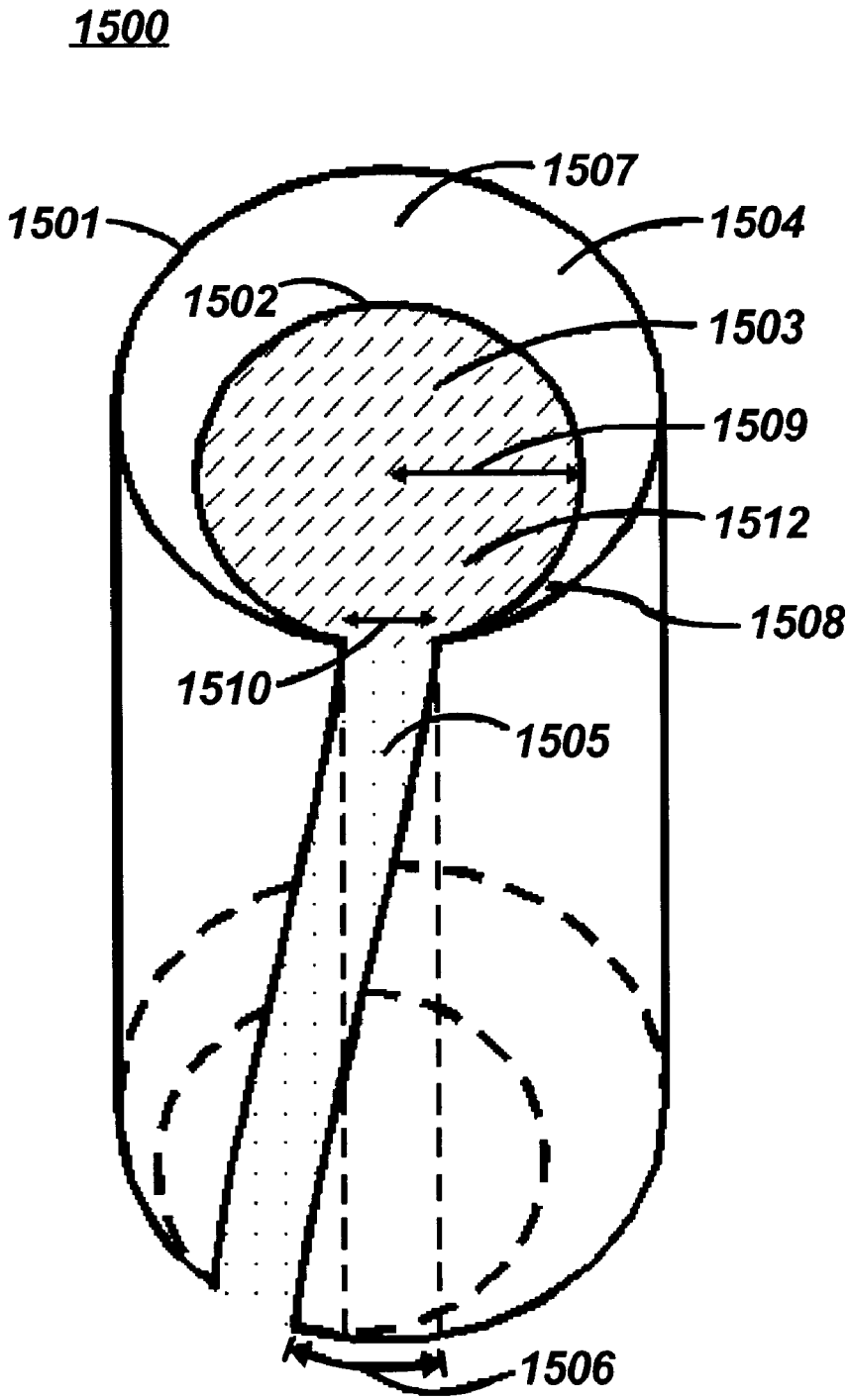
FIG. 15 illustrates a frontal overview of a hydrodynamic modeling of a main tubarc pattern showing the twisting of the longitudinal slit opening, in accordance with a preferred embodiment of the present invention.

FIG. 15 illustrates a frontal overview of a hydrodynamic system 1500 in the form of a main tubarc pattern showing the twisting of a slit opening, in accordance with an alternative embodiment of the present invention. A standard "tubarc" can be formed in the shape of a cylinder by a larger circle 1501 and a smaller circle 1502 order to form an opening, which possesses a width of approximately half 1510 of the radius 1509 of the smaller circle 1502. The tubarc of system 1500 also includes a weaker side 1508, which is important for physical support. The tubarc of system 1500 also includes a weaker side 1508, which is important to the connection of lateral flow. The dimensions of the outer circle 1501, the inner circle 1502, and the slit opening 1505 can vary to change the porosity ratios and physical strength aimed. A twisting detail 1506 is suggested for bulk assembling allowing random distribution of the slit opening providing an even spatial distribution. Fluids can move faster longitudinally inside the tubarc core 1503 having a high level of unsaturated flow anisotropy and slower laterally through the slid opening 1505.

Standardization of tubarc dimensions can promote a streamlined technological application. In order to control the size pattern, each unit of tubarc can be referred to as a "tuby" having an internal diameter, for example, of approximately 10 $\mu$m and a width of 2.5 $\mu$m in the longitudinal opening slit. All commercially available tubarcs can be produced in multiple units of "tuby". Consequently, unsaturated conductors can be marketed with technical descriptions of their hydrological functioning for each specific fluid within the unsaturated zone described in each increasing unsiphy macro units and varying tuby micro units. Unified measurement units are important to harness unsaturated flow utilizing an organized porosity.

Figures 16A, 16B:
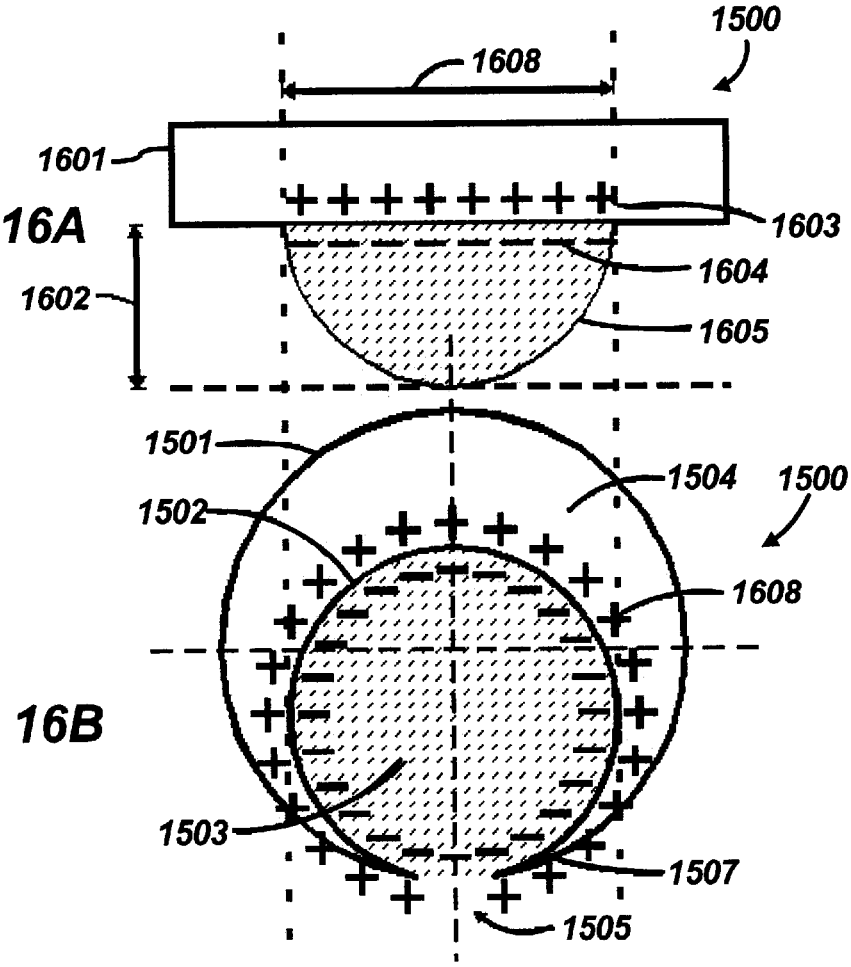
FIG. 16A depicts a cross-sectional view of hydrodynamic modeling forces of a water droplet hanging from a flat horizontal solid surface due to adhesion-cohesion properties, in accordance with a preferred embodiment of the present invention.
FIG. 16B illustrates a cross-sectional view of hydrodynamic modeling forces of water inside a tubarc structure and its circular concentric force distribution contrasted with the force distribution illustrated in 16A, in accordance with a preferred embodiment of the present invention.

FIG. 16A depicts a cross-sectional view of a system 1500 depicted in FIG. 15 representing hydrodynamic modeling forces associated with of a water droplet 1605 hanging from a flat horizontal solid surface 1601 due to adhesion-cohesion properties of water. It can be observed with the a naked eye that a water droplet 1605 hanging in a solid surface can have a height of approximately 4 mm 1602. Such a situation occurs in the case of water, during to hydrogen bonding of oxygen molecules in the liquid (represented as a sign), while maintaining a self internal adhesion-cohesion and providing attraction to a solid surface having an opposing charge (represented to a "+" sign). The signs "−" and "+" are simple symbols of opposite charges that can be utilized to demonstrate attraction and vice versa.

A water molecule, for example, generally includes an electric dipole having a partial negative charge at the oxygen atom and a partial positive charge at the hydrogen atom. This type of electrostatic attraction is generally referred to as a hydrogen bond. The diameter of water droplets can attain, for example, approximately, 6 mm, but the internal porosity of plant tissues suggests that the diameter of the tubarc core 1502 can lie in a range between approximately 10 $\mu$m and 100 $\mu$m. If such a diameter is more than 100 $\mu$m, the solid attraction in the porosity reduces enormously and the bear weight of the liquid also increases. Plants, for example, possess have air vessel conductors with diameters of approximately 150 $\mu$m.

FIG. 16B illustrates a cross-sectional view of system 1500 depicted in FIG. 15, including hydrodynamic modeling forces of water within a tubarc structure and its circular concentric force distribution contrasted with the force distribution of FIG. 16A. The attraction bonding in the internal surface of the cylinder 1502 is approximately three times larger than the attraction of its flat diameter 1502, but the concentric forces of the circle adds a special dragging support. By decreasing the geometric figure sizes the attraction power can be affected by a multiple of the radius ($\pi 2R$) while the volume weight is affected by the area of the circle ($\pi R^2$), which is affected by the power of the radius. Decreasing the diameter of a vertical tubarc core 1502 from 100 $\mu$m to 10 $\mu$m, the attraction in a cylinder 1502 reduces ten times (10×) while the volume of the fluid 1503 reduces a thousand times (1000×). Tubarc fibers arranged in a longitudinal display occupy around 45% of the solid volume having a permanent ratio of about 55% of void v/v. Changing the dimensions of the tubarc fibers can affect the attraction power by a fixed void ratio. Consequently, a standard measurement of attraction for unsaturated flow can be developed to control the characteristics of the solid and the liquid phases performing under standard conditions.

FIG. 17 depicts a spatial geometry arrangement of solid cylinders and jagged surface options to increase surface area, in accordance with a preferred embodiment of the present invention. It is more practical to use fibers of smaller diameters to increase the surface area. Each time the diameter of a fiber is reduced by half, the external surface area (perimeter) progressively doubles for the same equivalent volume as indicated circles 1703, 1702 and 1701. Rounded fibers joining each other can provide a void volume of approximately 12% to 22% depending on the spatial arrangements 1704 and 1705.

The unsaturated flow can be enhanced increasing the dragging power of the solid phase by augmenting the surface of the synthetic cylinders 1703 as suggested by different jagged formats 1706, 1707, 1708, 1709, 1710, and 1711. Note that the jagged surface of 1706 uses small tubarc structures.

FIGS. 18A to 18F depicts cross-sectional views of spatial geometry of cylindrical fibers having different formats and tubarc structures in accordance with a preferred embodiment of the present invention. FIG. 18A depicts a unique standard tubarc format. FIG. 18B illustrates a cylindrical fiber with an optionally centralized tubarc format having optionally rounded or non-rounded surfaces. The centralized tubarc format has the inner circle 1502 equally distant inside 1501 and the slit opening 1505 can have a longer entrance and the volume 1503 is slightly increased because of the entrance. The format in the FIG. 18B may have a different hydrodynamics functioning with advantages and disadvantages. In FIG. 18B, a rounded sample 1801 is illustrated. An optional non-round sample 1802 is also depicted in FIG. 18B, along with optional flat surfaces 1804 with varied geometry. An inward extension 1803 of the slit is additionally depicted in FIG. 18B. FIG. 18C depicts an ellipsoid fiber with two standard tubarcs. FIG. 18D illustrates a cylindrical fiber with three standard tubarcs. FIG. 18E depicts a cylindrical fiber with four standard tubarcs. FIG. 18F illustrates a squared fiber with multiple standard tubarcs in the sides. Several other formats are possible combining different geometric formats and tubarc conception, which can produce specific performance when used singly or in bulk assembling.

FIG. 19A depicts a cross-sectional view of a spatial geometry of cylindrical fibers with a unique standard tubarc in multiple bulky arrangement. If the twisting effect is applied to the making of the slit opening, a random distribution of the face to the tubarcs 1505 is attained. FIG. 19B illustrates a cross-sectional view of a spatial geometry of hexagonal fibers with three standard tubarcs in multiple bulky arrangement. FIG. 19C depicts a cross-sectional view of a spatial geometry of squared fibers with multiple standard tubarcs in multiple bulky arrangement. The bulky arrangement showed the characteristics of the porosity aimed when the fibers are combined longitudinally in-groups. The square format in FIG. 19C can provide a sturdier structure than FIG. 19A. FIG. 19C offers an option to build solid pieces of plastic having a stable porosity based on grouping of squared fibers.

Figures 20A, 20B, 20C, 20D:
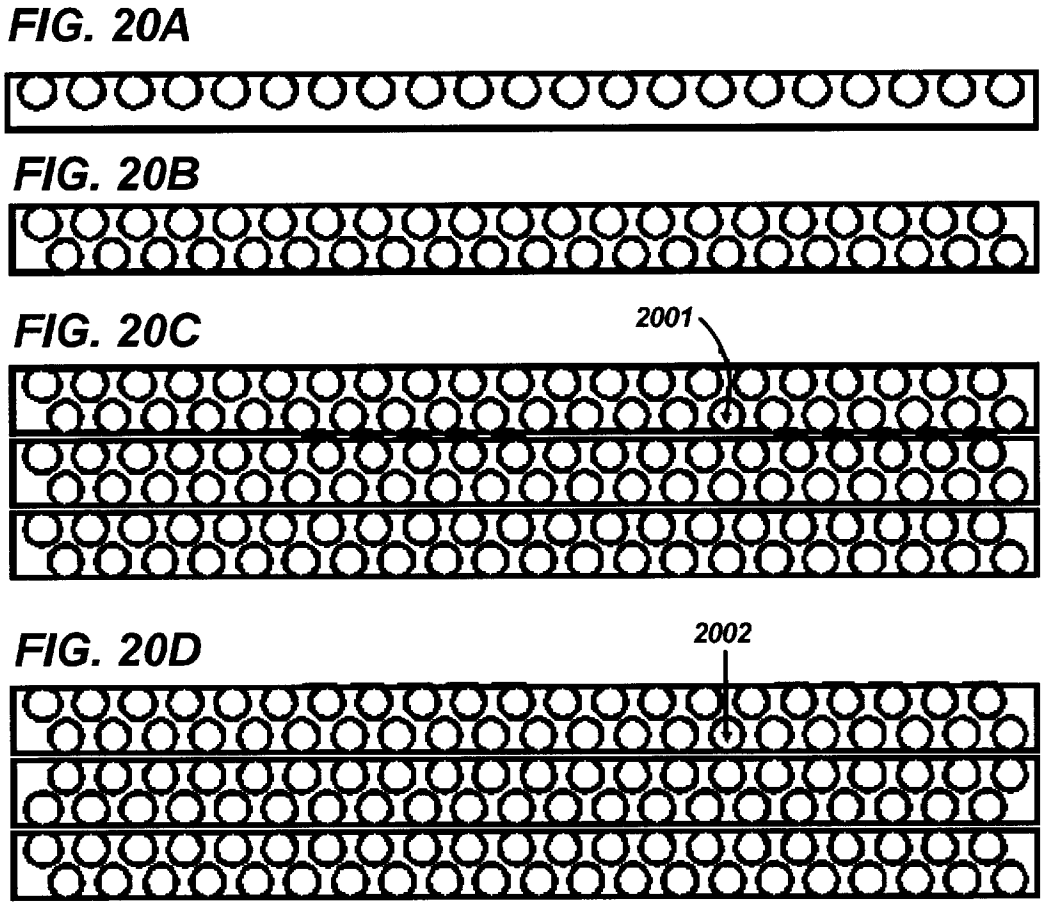
FIG. 20A illustrates a cross-sectional view of a spatial geometry of a laminar format one-side with multiple standard tubarcs, in accordance with a preferred embodiment of the present invention.
FIG. 20B depicts a cross-sectional view of a spatial geometry of a laminar format two-side with multiple standard tubarcs, in accordance with a preferred embodiment of the present invention.
FIG. 20C illustrates a cross-sectional view of a spatial geometry of a laminar format two-side with multiple standard tubarcs arranged in unmatching face tubarcs, in accordance with a preferred embodiment of the present invention.
FIG. 20D depicts a cross-sectional view of a spatial geometry of a laminar format two-side with multiple standard tubarcs arranged in matching face tubarcs, in accordance with a preferred embodiment of the present invention.

FIG. 20A illustrates a cross-sectional view of a spatial geometry of a laminar format one-side with multiple standard tubarcs. FIG. 20B depicts a laminar format two-side with multiple standard tubarcs. FIG. 20C illustrates a laminar format two-side with multiple standard tubarcs arranged in unmatching face tubarc 2001 slits. FIG. 20D depicts a laminar format two-side with multiple standard tubarcs arranged in matching face tubarc 2002 slits. The laminar format is important for building bulky pieces having a controlled porosity and a high level of anisotropy. A bulk arrangement of laminar formats having multiple tubarcs may offer many technological applications associated with unsaturated flow and hydrodynamics properties in particular spatial arrangements. Lubricant properties may comprise one such property.

Figure 21:
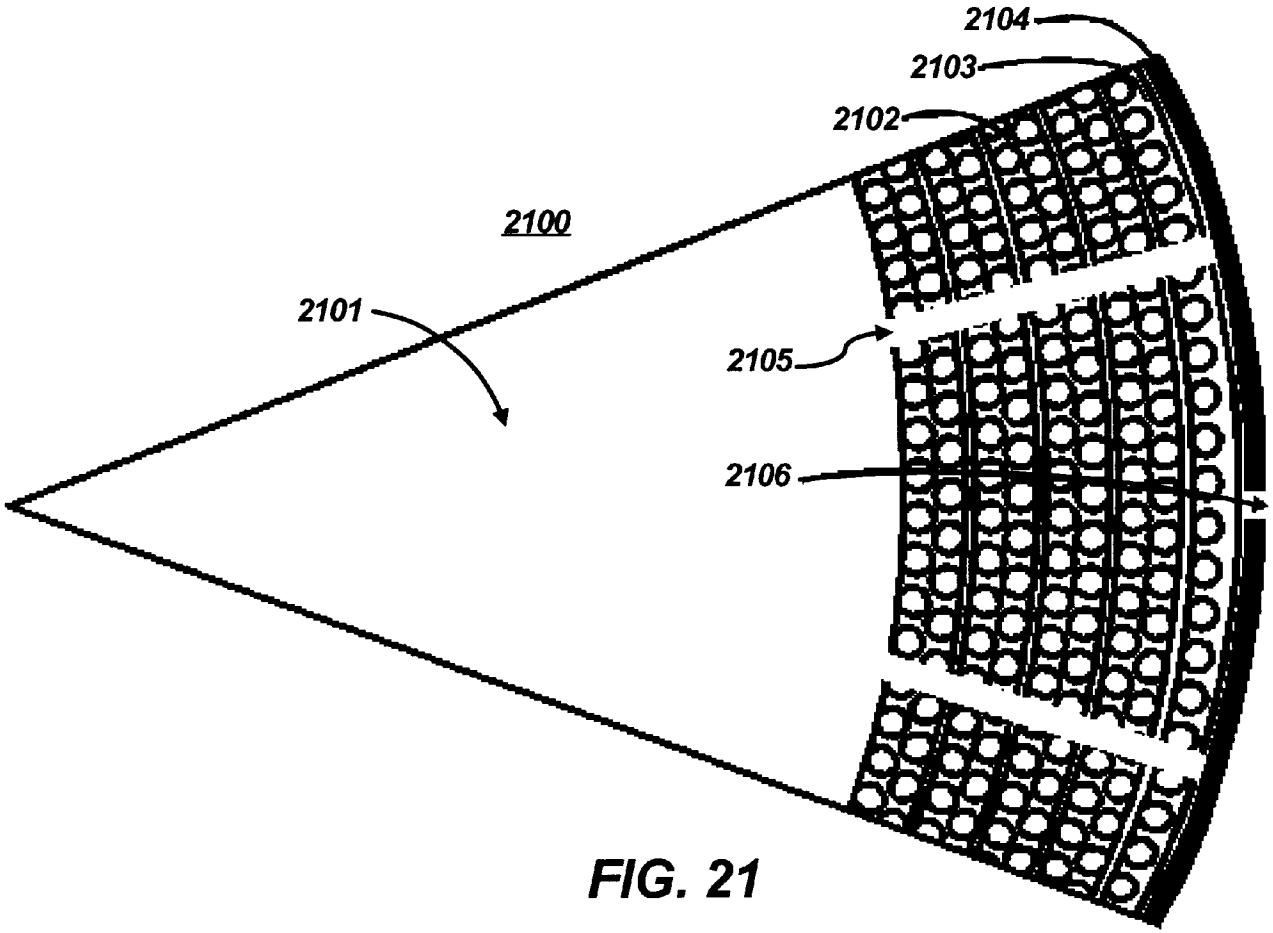
FIG. 21 illustrates a cross-sectional view of a spatial geometry of a cylinder sector of a tube structure to move fluids as unsaturated flow in tubular containment with bulky formats of multiples standard tubarcs, in accordance with a preferred embodiment of the present invention.

FIG. 21 illustrates a cross-sectional view of a spatial geometry of a cylinder sector of a tube structure to move fluids as unsaturated flow in tubular containment with bulky formats of multiples standard tubarcs, in accordance with a preferred embodiment of the present invention. An outer sealing layer 2104 and/or 2103, an empty core section 2101 and porosity section 2102 form the cylindrical format 2100. The porosity section 2102 can be assembled utilizing a bulky porous structure, or a fabric contention structure knitted from any of a variety tubarc synthetic fibers. If aeration is required in the tubular containment, then opening 2106, in holes or continuous slit, can be employed for such need. In FIG. 21, an optional connection 2105 between layers of laminar format is also illustrated.

Figure 22:
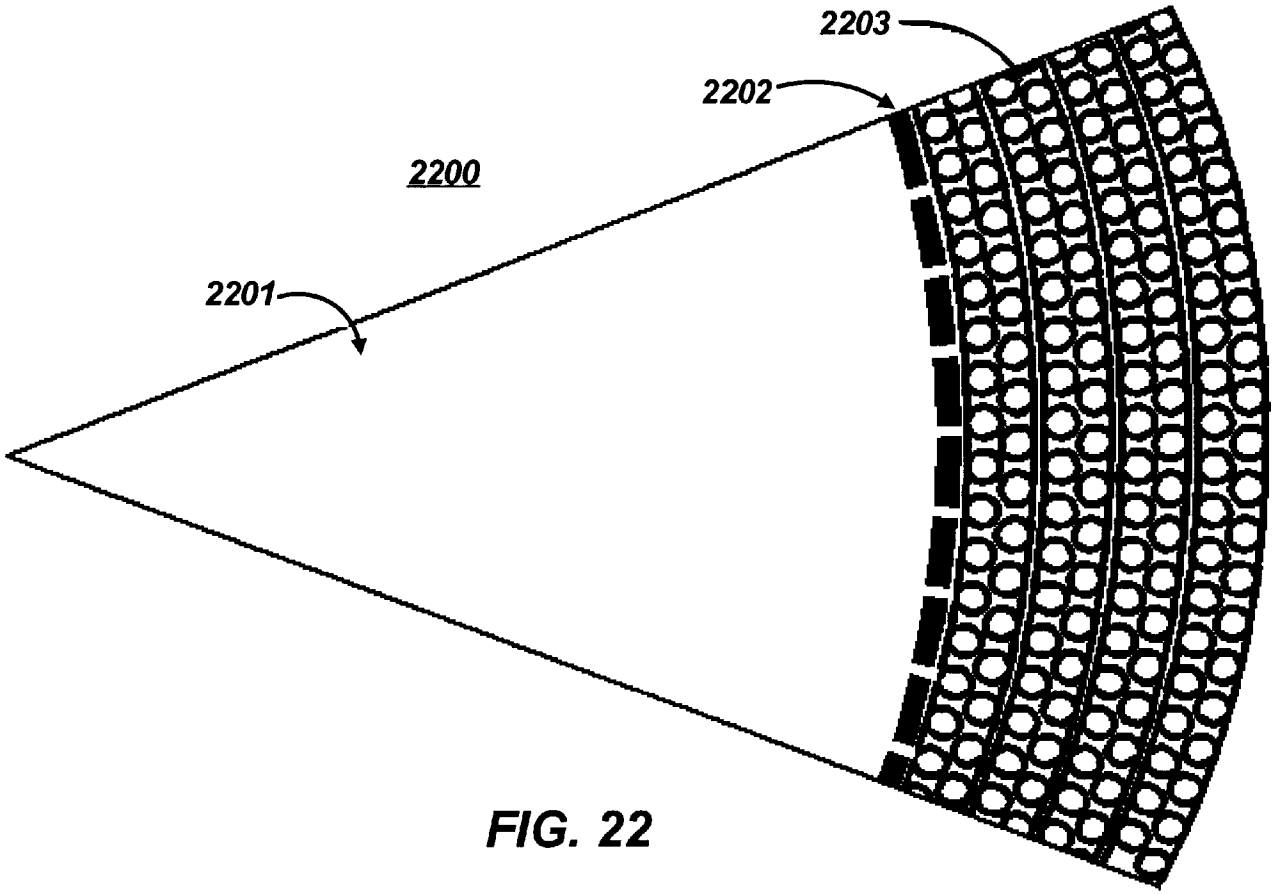
FIG. 22 depicts a cross-sectional view of a spatial geometry of a cylinder sector of a tube structure to move fluids as saturates/unsaturated flow in tubular containment with bulky formats of multiples standard tubarcs in the outer layer, in accordance with a preferred embodiment of the present invention.

FIG. 22 depicts a cross-sectional view of a spatial geometry of a cylinder sector of a tube structure to move fluids as saturated/unsaturated flow in tubular containment with bulky formats of multiples standard tubarcs in the outer layer 2203. The inner core of the tubular containment can move fluid in and out as saturated or unsaturated conditions. The layer 2202 is an optional support structure that allows fluid to move in and out of the core. The outer layer 2203 can be formed by any bulky tubarc porous microstructure.

Figures 23A, 23B, 23C, 23D, 23E, 23F:
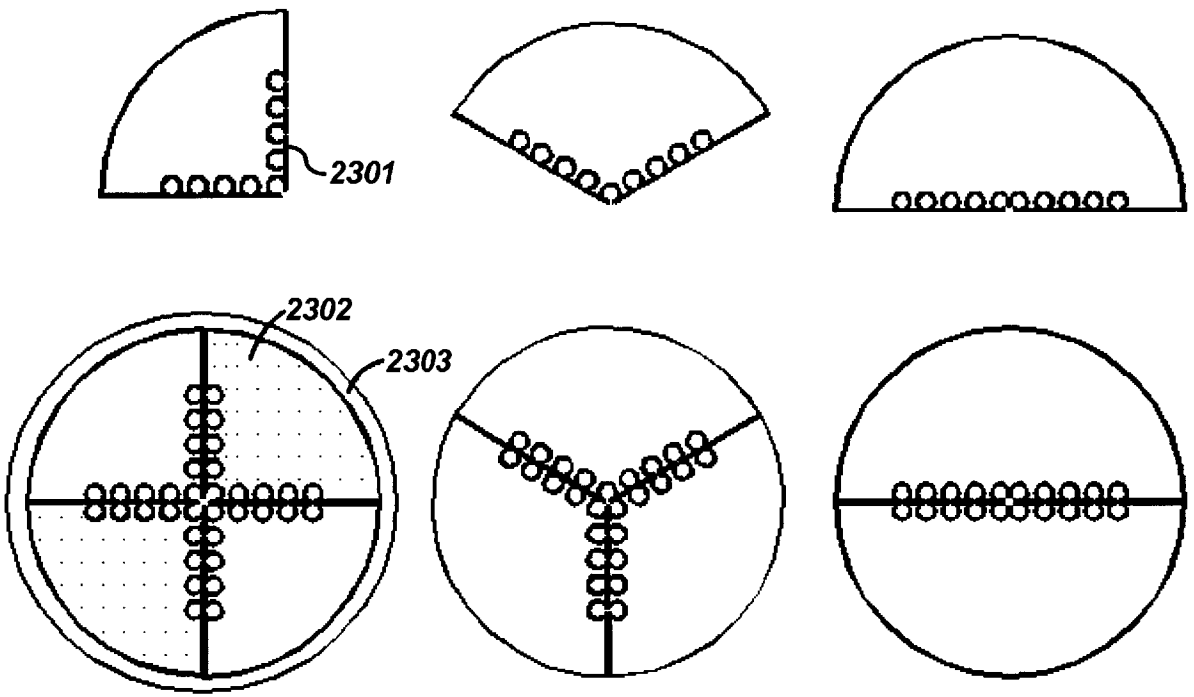
FIG. 23A illustrates a cross-sectional view of a spatial geometry of a cylinder quarter with standards tubarcs in the internal sides, in accordance with a preferred embodiment of the present invention.
FIG. 23B illustrates a cross-sectional view of a spatial geometry of a sturdy cylinder conductor formed by cylinder quarters with standard tubarcs in the internal sides, in accordance with a preferred embodiment of the present invention.
FIG. 23C illustrates a cross-sectional view of a spatial geometry of a cylinder third with tubarcs in the internal sides, in accordance with a preferred embodiment of the present invention.
FIG. 23D illustrates a cross-sectional view of a spatial geometry of a sturdy cylinder conductor formed by cylinder thirds with standard tubarcs in the internal sides, in accordance with a preferred embodiment of the present invention.
FIG. 23E illustrates a cross-sectional view of a spatial geometry of a cylinder half with tubarcs in the internal sides, in accordance with a preferred embodiment of the present invention.
FIG. 23F illustrates a cross-sectional view of a spatial geometry of a sturdy cylinder conductor formed by cylinder halves with standard tubarcs in the internal sides, in accordance with a preferred embodiment of the present invention.

FIG. 23A illustrates a cross-sectional view of a spatial geometry of a cylinder quarter with standards tubarcs 2301 in the internal sides. FIG. 23B illustrates a sturdy cylinder conductor formed by cylinder quarters with standard tubarcs in the internal sides. FIG. 23C illustrates a cylinder third with tubarcs in the internal sides. FIG. 23D illustrates a sturdy cylinder conductor formed by cylinder thirds with standard tubarcs in the internal sides. FIG. 23E illustrates a cylinder half with tubarcs in the internal sides. FIG. 23F illustrates a sturdy cylinder conductor formed by cylinder halves with standard tubarcs in the internal sides. If necessary the cylindrical microstructure can have an outer layer 2303 for physical containment. Also, air transmission inside the cylindrical structure can be attained optionally by manufacturing a part of the structure 2302 with fluid repellent material in order to provide an air conductor.

The flow rate of unsaturated siphons is generally based on an inverse curvilinear function to the penetration height of the siphon in the unsaturated zone, thereby attaining zero at the upper boundary. In order to quantify and set standards for a macro scale of spatial unsaturated flow, a specific measurement unit is generally defined as "unsiphy", symbolized by "⊓"—as an upward penetration interval of 2.5 cm in the unsaturated zone by the unsaturated siphon. Then, unsaturated siphons can be assessed in their hydrodynamic capacity to transmit fluids by the unsaturated hydraulic coefficients tested under unsiphy units "⊓". The unsaturated hydraulic coefficient is the amount of fluid (cubic unit—$mm^3$) that moves through a cross-section (squared unit—$mm^2$) by time (s). Then, an unsiphy unsaturated hydraulic coefficient is the quantification of fluid moving upward 2.5 cm and downward 2.5 cm in the bottom of the unsaturated zone by the unsaturated siphon (⊓mm$^3$/mm$^2$/s or ⊓mm/s). Multiples and submultiples of unsiphy ⊓ can be employed. All commercially available unsaturated siphons are generally marketed with standard technical descriptions of all of their hydrological functioning for each specific fluid within the unsaturated zone described in each increasing unsiphy units possible up to the maximum fluid rise registered. This can be a table or a chart display describing graphically the maximum transmittance near the hydraulic head decreasing to zero at the maximum rise.

Synthetic fibers made of flexible and inert plastic can provide solid cylinders joining in a bundle to form an enhanced microstructured porosity having a columnar matrix format with constant lateral flow among the cylinders. The solid cylinders can have jagged surfaces in several formats in order to increase surface area, consequently adding more attraction force to the porosity. Plastic chemistry properties of attraction of the solid phase can fit to the polarity of the fluid phase. Spatial geometry patterns of the porosity can take into account the unsaturated flow properties according to the fluid dynamics expected in each application: velocity and fluid matric potential.

A fluid generally possesses characteristics of internal adhesion-cohesion, which leads to its own strength and attraction to the solid phase of porosity. Capillary action is a theoretical proposal to deal with fluid movement on porous systems, but capillary action is restricted to tubing geometries that are difficult to apply because such geometries do not permit lateral fluid flow. Nevertheless, the geometry of the cylinder is one of the best rounding microstructure to concentrate attraction toward the core of the rounding circle because the cylinder only permits longitudinal flow. In order to provide a required lateral flow in the porosity, a special geometric figure of tube like is disclosed herein. Such a geometric figure is defined herein as simply comprising a "tubarc"—a combination of a tube with an arc.

Recent development of synthetic fiber technology offers appropriate conditions to produce enhanced microporosity with high level of anisotropy for fluid retention and transmission as unsaturated flow. The tubarc geometry of the present invention thus comprises a tube-like structure with a continuous longitudinal narrow opening slit, while maintaining most of a cylindrical-like geometric three-dimensional figure with an arc in a lateral containment, which preserves approximately 92% of the perimeter. The effect of the perimeter reduction in the tubarc structure is minimized by bulk assembling when several tubarcs are joined together in a bundle. The synthetic fiber cylinder of tubarc can bear as a standard dimension of approximately 50% of its solid volume reduced and the total surface area increased by approximately 65%.

A tubarc thus can become a very special porous system offering high reliability and efficiency. It can bear around half of its volume to retain and transmit fluid with a high-unsaturated hydraulic coefficient because of the anisotropic porosity in the continuous tubarcs preserving lateral flow in all its extent. The spatial characteristic of tubarcs offers high level of reliability for handling and braiding in several bulk structures to conduct fluids safely.

The tubarc of the present invention thus comprises a geometric spatial feature that offers conceptions to replace capillary tube action. The tubarc has a number of characteristics and features, including a high level reduction of the fiber solid volume, a higher increased ratio of surface area, the ability to utilize chemically inert and flexible porous media and a high level of anisotropy for saturated and unsaturated flow. Additional characteristics and features of such a tubarc can include a high reliability for bearing an internal controlled porosity, a high level of void space in a continuous cylindrical like porous connectivity, a filtering capability associated with the size control of porosity, and variable flow speed and retention by changing porosity size and spatial arrangement. Additionally, the tubarc of the present invention can be constructed of synthetic or plastic films and solid synthetic or plastic parts.

A number of advantages can be achieved due to unsaturated flow provided by the enhanced spatial geometry of a tubarc with multiple directional flows. The size of the opening can be configured approximately half of the radius of the internal circle of the tubarc, although such features can vary in order to handle fluid retention power and unsaturated hydraulic conductivity. The tubarc has two main important conceptions, including the increased ratio of solid surface by volume and the partitioning properties enclosing a certain volume of fluid in the arc. The partitioning results in a transversal constricting structure of the arc format, while offering a reliable porosity structure with a strong concentrated solid attraction to reduced contained volume of fluid. Partitioning in this manner helps to seize a portion of the fluid from its bulk volume, reducing local adhesion-cohesion in the fluid phase.

Ideally, Tubarc technology should have some sort of standardizing policy to take advantage of porosity production and usage. In order to control the size pattern of tubarcs, a unit of tubarc can be referred to as "tuby" corresponding to an internal diameter of 10 $\mu$m and a width of 2.5 $\mu$m in the longitudinal opening slit. All tubarc unsaturated conductors can be marketed with technical descriptions of all of their hydrological functioning for each specific fluid regarded inside the unsaturated zone described in each increasing tuby and unsiphy units. This procedure offers a high reliance in the macro and micro spatial variability of porosity for harnessing unsaturated flow.

A common circle of a cylinder has an area around 80% of the equivalent square. When several cylinders are joined together, however, the void area reduces and the solid area increases to approximately 90% due to a closer arrangement. The tubarc of the present invention can offer half of its volume as a void by having another empty cylinder inside the main cylindrical structure. Then, the final porosity of rounded fiber tubarcs can offer a safe porosity of approximately 45% of the total volume with a high arrangement for liquid transmission in the direction of longitudinal cylinders of the tubarcs. The granular porosity has approximately 50% of void due to the fact that spheres takes near half of equivalent their cubic volume. Consequently, tubarcs may offer porosity near the ratio of random granular systems, but also promotes a highly reliable flow transmission offering a strong anisotropic unsaturated hydraulic flow coefficient. Tubarc offers a continuous reliable enhanced microporosity shaped close to tube format in a longitudinal direction. Anisotropy is defined as differential unsaturated flow in one direction in the porosity, and this feature becomes highly important for flow movement velocity because of the features of this physical spatial porosity that removes dead ends and stagnant regions in the void.

The tubarc of the present invention is not limited dimensionally. An ideal dimension for the tubarc is not necessary, but a trade-off generally does exist between the variables of the tubarc that are affected by any changes in its dimensions. Attraction of the solid phase is associated with the perimeter of the circle, while the bearing weight of the fluid mass is associated to the area of the circle. Thus, each time the radius of the inner circle in the tubarc doubles, the perimeter also increases two times; however, the area of the circle increases to the squared power of the radius unit. For example, if the radius increases ten times, the perimeter can also increase ten times and the area can increase a hundred times. Since the void ratio is kept constant for a bulk assembling of standard tubarc fibers, changing in the dimensions affect the ratio of attraction power by a constant fluid volume.

The system becomes even more complex because the holding capacity of the porosity has multidirectional connective effect of inner fluid adhesion-cohesion, pulling the molecules down or up. Then, the unsaturated flow movement is a resultant of all the vertical attraction in the solid phase of cylinder by the bearing weight of the fluid linked to it. The maximum capillary rise demonstrates the equilibrium between the suction power of the solid porous phase of tubes, the suction power of the liquid laminar surface at the hydraulic head, and the fluid bearing weight. Using common cords braided with solid cylinders of synthetic fibers without tubarc microporosity, a maximum water rise of near two feet has been registered.

Live systems can provide some hints that water moves in vessels with cross-section smaller than 100 $\mu$m. The granular systems offer a natural porosity of approximately 50% in soils. Then, it is expected that ratios of porosity between 40% and 60% can fit to most requirements of flow dynamics. Finally, an improved performance may result by changing the smooth surface of the cylindrical fibers to jagged formats increasing even more the unit of surface attraction by volume.

The present invention discloses herein describes a new conception of unsaturated flow to replace capillarity action functioning that does not possess lateral flow capabilities for an associated tube geometry. Until now the maximum registered unsaturated flow coefficient of hydraulic conductivity upward using common cords having no tubarc microporosity was 2.18 mm/s which is suited even to high demands for several applications like irrigation and drainage.

The unsaturated siphon offers special macro scale features, such as reversibility and enhanced fluid functioning when the compartments are specially combined to take advantage of the unsaturated flow gradients. Thus, fluids can be moved from one place to another with self-sustaining characteristics and released at adjustable fluid matric potentials. The unsaturated reversible siphon can perform fluid supply or drainage, or transport of solutes, or suspended substances in the unsaturated flow itself. The tubarc action microporosity offers special features for fluid dynamics ensuring reliability in the fluid movement and delivery. Fluids can be moved from one place to another at a very high precision in the quantity and molecular cohesion in the fluid matric potential.

The present invention generally discloses a reversible unsaturated siphon having a physical macrostructure that may be formed from a bundle of tubes (e.g., plastic) as synthetic fibers with a tubarc microstructure porosity ensuring around half the volume as an organized cylindrical spatial geometry for high anisotropy of unsaturated flow. The reversible unsaturated siphon disclosed herein offers an easy connection among multiple compartments having different fluid matric potential. The upside down "U" shape of the reversible unsaturated siphon is offered as spatial arrangement when working under gravity conditions. This feature offers a self-sustaining system for moving fluid between multiple compartments attending to a differential gradient of fluid matric potential in any part of the connected hydrodynamic system.

This present invention is based on the fact that porosity can be organized spatially having a specific and optimum macro and micro geometry to take advantages of unsaturated flow. Simple siphons can be manufactured inexpensively utilizing available manufacturing resources of, for example, recently developed plastics technology. The reversible unsaturated siphon disclosed herein comprises a tubarc porous physical microstructure for multidirectional and optionally reversible unsaturated flow and in a practical implementation can be utilized to harness important features of unsaturated flow. Fluids have characteristics of internal adhesion-cohesion leading to its own strength and attraction to the solid phase of porosity. Capillary action is a theoretical proposal to deal with fluid movement on porous systems; however, as explained previously, capillary action is restricted to tubing geometry background of difficult application for missing lateral unsaturated flow.

The reversible unsaturated siphon disclosed herein also comprises tubarc porous physical microstructure that can offer several important features of reliability, flow speed, continuity, connectivity, and self-sustaining systems. It is more practical to manufacture tubarcs than capillary tubes for industrial application. Synthetic fibers technology can supply tubarcs, which combined together in several bulky structures, can offer an efficient reversible unsaturated siphon device for continuous and reliable unsaturated flow.

Unsaturated flow efficiency and reliability is highly dependent on a perfect spatial geometry in the porosity in order to prevent flow interruption and achieve high performance. Also, enhanced unsaturated flow systems like the reversible unsaturated siphon can provide a cyclical combination of saturation/unsaturation as an alternative to rescue unsaturation flow continuity mainly to granular porous media preventing unknown expected interruptions. This invention offers new conceptions of science and a broad industrial application of unsaturated flow to hydrodynamics.

The tubarc porous physical microstructure disclosed herein may very well represent the utmost advancement of spatial geometry to replace capillarity. The rounded geometry of tubes is important to unsaturated flow for concentrating unit of surface attraction by volume of fluid attracting to it in a longitudinal continuous fashion. Instead of having liquid moving inside a tube, it moves inside a tubarc microstructure, which is a tube with a continuous opening in one side offering a constant outflow possibility throughout all its extension. Because fluid does not run inside the tubes, laws of capillary action based on tube geometry no longer fit into the fluid delivery system of the present invention because a change in the geometrical format of the solid phase has a specific physical arrangement of solid material attracting the fluid of unsaturated flow.

The present invention thus discloses a special geometry for improving the parameters of unsaturated flow, offering continuous lateral unsaturated flow in all the extent of the tube-like structure. The present invention also teaches a special spatial macro scale arrangement of an unsaturated siphon in which fluid or liquid can move at high reliability and flow velocity from one compartment to another compartment at variable gradients of fluid matric potential. The present invention also sets standards to gauge unsaturated flow moving as unsiphy macro units according to the penetration extension upward in the unsaturated zone and tuby micro standardized dimensions in the tubarcs. The proposed quantification conceptions described herein for measuring standards can be utilized to assess macro and micro scales and to harness unsaturated flow based on hydrodynamics principles. This analytical quantification represents a scientific advancement toward the measurement of fluid adhesion-cohesion in the molecular connectivity affected by the porosity during unsaturated flow.

When a fluid moves as unsaturated flow, it is affected by the porosity geometry, which reduces the internal cohesion of the fluid, making it move in response to a gradient of solid attraction. Continuity is an important factor to develop reliability in unsaturated flow. Continuous parallel tubarcs offer this feature of continuity, thereby preventing dead ends or stagnant regions common to the random porosity. The tubarcs offers a highly advanced anisotropic organized microporous system to retain and/or transfer fluids, where around 50% of the volumes as voids are organized in a longitudinal tube like microporosity.

Recent developments of plastic technology have produced synthetic fibers, which are an inexpensive source of basic material for assembling special devices to exploit and harness unsaturated flow. The chemistry of such plastic material is generally dependent on the polarity of the fluid utilized. Also, there is no specific optimum tubarc size, but a tradeoff occurs accounting for volume and speed of unsaturated flow. Water can move in plant tissues vessels having a cross-section smaller than 100 $\mu$m.

A tubarc device, as described herein with respect to vary embodiments may be configured so that approximately half of its volume is utilized as a void for longitudinal continuous flow with a constant lateral connection throughout a continuous open slit in one side thereof offering a multidirectional unsaturated flow device (i.e. a "tubarc"). When the surface area by volume of the solid phase of the rounded fibers is increased, the dragging power associated with unsaturated flow can be augmented. The rounded surface area of the cylinders doubles each time the diameter of the fibers doubles, thereby maintaining the same void space ratio for liquid movement. If the fibers are close to each other, the void space is approximately 22% v/v, but can be reduced to approximately 12% if tightly arranged. Granular systems can offer a natural porosity of approximately 50%. Thus, ratios of porosity between approximately 40% and 60% can fit to most required flow dynamics. Different results, however, can be obtained if the surface of the cylinders (e.g., cylinders of FIGS. 17A to 17H) is increased or altered. This can occur by changing a smooth surface to a jagged surface and implementing different formats.

Embodiments of the present invention disclose a new conception for unsaturated flow, thereby replacing capillary-based principals, which lack lateral flow in the tube geometry. Embodiments therefore illustrate a special arrangement of a reversible unsaturated siphon to take advantage of unsaturated flow between different compartments having a differential fluid matric potential. The siphon device described herein offers high a reliability for using unsaturated flow, particularly when fluids need to be relocated from one place to another with some inner self-sustaining functioning and variable fluid matric potential at the outlet, according to the conceptions of hydrodynamics. The tubarc microporosity ensures a reliable application of unsaturated siphon offering innumerous singly or complex bulky porosity.

Generally, the best braiding configurations that can be obtained are those which can maintain an even distribution of common fibers throughout a the cross section without disrupting the spatial pattern of the porosity, thereby allowing flow reversibility and uniform unsaturated flow conductivity. Until now however without employing in tubarcs as described herein, the maximum registered unsaturated flow coefficient of hydraulic conductivity was approximately 2.18 mm/s, which is not well suited to the high demands of several fluid applications, such as, for example, field irrigation and drainage.

A variety of commercial hydrology applications can be implemented in accordance with one or more embodiments. For example, the fluid delivery methods and systems described herein can be utilized in horticulture to improve the hydrology of common pots, or enable common pots to function as hydrologically "smart" self-sustaining systems. Additionally, embodiments can also be implemented for controlling a water and nutrient supply while maintaining minimal waste. Common pots, for example, can attain "never clogging" characteristics because excessive water can be removed by drainage using the molecular attraction of an advanced microporosity performing unsaturated flow as described and illustrated herein with respect to embodiments of the present invention.

Additionally, in irrigation scenarios, embodiments can be implemented and utilized to provide a system of irrigation based on an interface of unsaturated flow. Also, embodiments can be implemented for drainage purposes, by permitting the removal of liquid via the molecular attraction of unsaturated flow. Embodiments can also be applied to inkjet printing technology, offering fluid in a very precise and reliable flow under control of fluid matric potential, due to enhanced liquid dynamics for recharging cartridges, or in general, supplying ink.

Because an alternative embodiment of the present invention can permit a continuous amount of ink in a writing tool tip from becoming faint, an embodiment can be ideal for implementation in writing tools, such as pens and markers. For example, erasable ink markers for writing on glass formed over a white background can revolutionize the art of public presentation, mainly in classrooms, by providing an enhanced device that is instantaneously and inexpensively recharged, while maintaining the same ink quality. Inkpads also can be equipped with have a small deposit of ink while being recharged continuously, thereby always providing the same amount of ink in the pad. Alternative embodiments can also implement water filtering systems in an inexpensive manner utilizing the concepts of unsaturated flow disclosed herein.

Another advantage of the present invention lies in the area of biochemical analysis. It can be appreciated, based on the foregoing, that the tubarc porous microstructure of the present invention, along with the "saturation, unsaturation, saturation" process described herein can be utilized to implement ion-exchange chromatography. Finally, special devices based on the methods and systems described herein, can be utilized to study soil-water-plant relationships in all academic levels from grade school to graduate programs. A scientific tool of this type may be particularly well suited for students because it can be utilized to teach environmental principals under controlled conditions, offering a coherent explanation of how life continues under survival conditions at optimum levels without squandering natural resources.

The fertile lowlands worldwide have the most fertile soils for concentrating nutrients in the hydrological cycles. Also, the most important cities were built around the water bodies beings constantly harmed by flooding. The present invention offers a very special way to remove water as drainage by molecular attraction inexpensively utilizing unsaturated flow features. The present invention can thus assist in minimizing flooding problems in the fertile lowlands and populated urban areas in the flooding plains or near bodies of water.

The present invention disclosed herein thus describes methods and systems for harnessing an unsaturated flow of fluid utilizing a tubarc porous microstructure. Fluid is conducted from a saturated zone to an unsaturated zone utilizing a tubarc porous microstructure. The fluid can thus be delivered from the unsaturated zone to the saturated zone through the tubarc porous microstructure, thereby permitting the fluid to be harnessed through the hydrodynamic movement of the fluid from one zone of saturation or unsaturation to another. The fluid is reversibly transportable from the saturated zone to the unsaturated zone and from the unsaturated zone to the unsaturated zone utilizing the tubarc porous microstructure. Fluid can also be hydrodynamically transported through the tubarc porous microstructure according to a gradient of unsaturated hydraulic conductivity, in accordance preferred or alternative embodiments of the present invention. Fluid can be conducted through the tubarc porous microstructure, such that the fluid is conductible through the tubarc porous microstructure in a reversible longitudinal unsaturated flow and/or reversible lateral unsaturated flow.

Fluid can be harnessed for a variety of purposes, in accordance with preferred or alternative embodiments of the present invention. The fluid can be harnessed, for example for a drainage purpose utilizing the tubarc porous microstructure through the hydrodynamic conduction of the fluid from one zone of saturation or unsaturation to another. The fluid can also be harnessed for an irrigation purpose utilizing the tubarc porous microstructure through the hydrodynamic conduction of the fluid from one zone of saturation or unsaturation to another. The tubarc porous microstructure described and claimed herein can thus be utilized in irrigation implementations. Additionally, as indicated herein, the fluid can be harnessed for a fluid supply purpose utilizing the tubarc porous microstructure through the hydrodynamic conduction of the fluid from one zone of saturation or unsaturation to another. In addition, the fluid can be harnessed for a filtering purpose utilizing the tubarc porous microstructure through the hydrodynamic conduction of the fluid from one zone of saturation or unsaturation to another.

The tubarc porous microstructure described herein can additionally be configured as a siphon. Such a siphon may be configured as a reversible unsaturated siphon. Additionally, such a reversible unsaturated siphon can be arranged in a spatial macro geometry formed from a plurality of cylinders of synthetic fibers braided to provide an even distribution of a longitudinal solid porosity and a uniform cross-sectional pattern. Such a plurality of cylinders can be configured, such that each cylinder of the plurality of cylinders comprises a smooth or jagged surface to increase an area of contact between a fluid and the longitudinal solid porosity.

The embodiments and examples set forth herein are presented to best explain the present invention and its practical application and to thereby enable those skilled in the art to make and utilize the invention. Those skilled in the art, however, can recognize that the foregoing description and examples have been presented for the purpose of illustration and example only. Other variations and modifications of the present invention will be apparent to those of skill in the art, and it is the intent of the appended claims that such variations and modifications be covered. The description as set forth is not intended to be exhaustive or to limit the scope of the invention. Many modifications and variations are possible in light of the above teaching without departing from scope of the following claims. It is contemplated that the use of the present invention can involve components having different characteristics. It is intended that the scope of the present invention be defined by the claims appended hereto, giving full cognizance to equivalents in all respects.

What is claimed is:

1. A method for harnessing an unsaturated flow of fluid utilizing a tubarc porous microstructure, said method comprising the steps of:

conducting a fluid from a saturated zone to an unsaturated zone utilizing a tubarc porous microstructure; and delivering said fluid from said unsaturated zone to said saturated zone through said tubarc porous microstructure, thereby permitting said fluid to be harnessed through the hydrodynamic movement of said fluid from one zone of saturation or unsaturation to another.

2. The method of claim 1 wherein said fluid is reversibly transportable from said saturated zone to said unsaturated zone and from said unsaturated zone to said saturated zone utilizing said tubarc porous microstructure.

3. The method of claim 1 wherein said fluid is hydrodynamically transportable through said tubarc porous microstructure according to a gradient of unsaturated hydraulic conductivity.

4. The method of claim 1 further comprising the step of: conducting said fluid through said tubarc porous microstructure, such that said fluid is conductible through said tubarc porous microstructure in a reversible longitudinal unsaturated flow.

5. The method of claim 1 further comprising the step of: conducting said fluid through said tubarc porous microstructure, such that said fluid is conductible through said tubarc porous microstructure in a reversible lateral unsaturated flow.

6. The method of claim 1 further comprising the step of: conducting said fluid through said tubarc porous microstructure, such that said fluid is conductible through said tubarc porous microstructure in a reversible transversal unsaturated flow.

7. The method of claim 1 further comprising the step of: harnessing said fluid for a drainage purpose utilizing said tubarc porous microstructure through the hydrodynamic conduction of said fluid from one zone of saturation or unsaturation to another.

8. The method of claim 1 further comprising the step of: harnessing said fluid for an irrigation purpose utilizing said tubarc porous microstructure through the hydrodynamic conduction of said fluid from one zone of saturation or unsaturation to another.

9. The method of claim 1 further comprising the step of: harnessing said fluid for a fluid supply purpose utilizing said tubarc porous microstructure through the hydrodynamic conduction of said fluid from one zone of saturation or unsaturation to another.

10. The method of claim 1 further comprising the step of: harnessing said fluid for a filtering purpose utilizing said tubarc porous microstructure through the hydrodynamic conduction of said fluid from one zone of saturation or unsaturation to another.

11. The method of claim 1 wherein the step of conducting a fluid from a saturated zone to an unsaturated zone utilizing a tubarc porous microstructure, further comprises the step of: hydrodynamically conducting a fluid from a saturated zone to an unsaturated zone utilizing a tubarc porous microstructure.

12. The method of claim 11 wherein the step of delivering said fluid from said unsaturated zone to said saturated zone through said tubarc porous microstructure, further comprises the step of: hydrodynamically delivering said fluid from said unsaturated zone to said saturated zone through said tubarc porous microstructure.

13. The method of claim 1 wherein the steps of: conducting a fluid from a saturated zone to an unsaturated zone utilizing a tubarc porous microstructure; and delivering said fluid from said unsaturated zone to said saturated zone through said tubarc porous microstructure; respectively further comprise the steps of:

conducting a fluid from a saturated zone to an unsaturated zone through an unsaturated conductor of fluid having a tubarc physical microstructure for multidirectional and optionally reversible unsaturated flow; and delivering said fluid from said unsaturated zone to said saturated zone through said unsaturated conductor.

14. The method of claim 1 wherein said tubarc porous microstructure comprises a siphon.

15. The method of claim 14 wherein said siphon comprises a reversible unsaturated siphon.

16. The method of claim 15 further comprising the step of: arranging said reversible unsaturated siphon in a spatial geometry formed from a plurality of cylinders of synthetic fibers braided to provide an even distribution of a longitudinal solid porosity and a uniform cross-sectional pattern.

17. The method of claim 16 further comprising the step of: configuring said plurality of cylinders such that each cylinder of said plurality of cylinders comprises a smooth or jagged surface to increase an area of contact between a fluid and said longitudinal solid porosity.

18. A method for harnessing an unsaturated flow of fluid utilizing a reversible unsaturated siphon, said method comprising the steps of:

conducting a fluid from a saturated zone to an unsaturated zone utilizing a reversible unsaturated siphon having a macro geometry for multidirectional and optionally reversible unsaturated flow; and delivering said fluid from said unsaturated zone to said saturated zone through said a reversible unsaturated siphon, thereby permitting said fluid to be harnessed through the hydrodynamic movement of said fluid from one zone of saturation or unsaturation to another, such that said fluid is reversibly transportable from said saturated zone to said unsaturated zone and from said unsaturated zone to said saturated zone utilizing said reversible unsaturated siphon.

19. A system for harnessing an unsaturated flow of fluid utilizing a tubarc porous microstructure, said system comprising:

a tubarc porous microstructure for conducting a fluid from a saturated zone to an unsaturated zone; and said fluid delivered from said unsaturated zone to said saturated zone through said tubarc porous microstructure, thereby permitting said fluid to be harnessed through the hydrodynamic movement of said fluid from one zone of saturation or unsaturation to another.

20. The system of claim 19 wherein said fluid is reversibly transportable from said saturated zone to said unsaturated zone and from said unsaturated zone to said saturated zone utilizing said tubarc porous microstructure.

21. The system of claim 19 wherein said fluid is hydrodynamically transportable through said tubarc porous microstructure according to a gradient of unsaturated hydraulic conductivity.

22. The system of claim 19 wherein said fluid is conductible through said tubarc porous microstructure in a reversible longitudinal unsaturated flow.

23. The system of claim 19 wherein said fluid is conductible through said tubarc porous microstructure in a reversible lateral unsaturated flow.

24. The system of claim 19 wherein said fluid is conductible through said tubarc porous microstructure in a reversible transversal unsaturated flow.

25. The system of claim 19 wherein said tubarc porous microstructure is adapted for use in fluid drainage.

26. The system of claim 19 wherein said tubarc porous microstructure is adapted for use in irrigation.

27. The system of claim 19 wherein said tubarc porous microstructure is adapted for use in supplying said fluid from a fluid source.

28. The system of claim 19 wherein said tubarc porous microstructure is adapted for use in filtration.

29. The system of claim 19 wherein said fluid is hydrodynamically conducted from a saturated zone to an unsaturated zone utilizing said tubarc porous microstructure.

30. The system of claim 29 wherein said fluid is hydrodynamically delivered said unsaturated zone to said saturated zone through said tubarc porous microstructure.

31. The system of claim 19 wherein said tubarc porous structure comprises an unsaturated conductor of fluid having a tubarc physical microstructure for multidirectional and optionally reversible unsaturated flow.

32. The system of claim 19 wherein said tubarc porous microstructure comprises a siphon.

33. The system of claim 32 wherein said siphon comprises a reversible unsaturated siphon.

34. The system of claim 33 wherein said reversible unsaturated siphon is arranged in a spatial geometry formed from a plurality of cylinders configured, such that each cylinder of said plurality of cylinders comprises a smooth or jagged surface that increases an area of contact between a fluid and said longitudinal solid porosity.

35. A system for harnessing an unsaturated flow of fluid utilizing a reversible unsaturated siphon, said system comprising:

conducting a fluid from a saturated zone to an unsaturated zone utilizing a reversible unsaturated siphon having a geometry for multidirectional and optionally reversible unsaturated flow; and delivering said fluid from said unsaturated zone to said saturated zone through said a reversible unsaturated siphon, thereby permitting said fluid to be harnessed through the hydrodynamic movement of said fluid from one zone of saturation or unsaturation to another, such that said fluid is reversibly transportable from said saturated zone to said unsaturated zone and from said unsaturated zone to said saturated zone utilizing said reversible unsaturated siphon.

* * * * *